US011732392B2

(12) United States Patent
Osamura et al.

(10) Patent No.: US 11,732,392 B2
(45) Date of Patent: Aug. 22, 2023

(54) EMBROIDERY FRAME AND SEWING MACHINE

(71) Applicant: BROTHER KOGYO KABUSHIKI KAISHA, Nagoya (JP)

(72) Inventors: Takahira Osamura, Kitanagoya (JP); Akihiro Hibino, Nagoya (JP); Mitsuhiro Iida, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 42 days.

(21) Appl. No.: 17/199,063

(22) Filed: Mar. 11, 2021

(65) Prior Publication Data

US 2022/0098775 A1 Mar. 31, 2022

(30) Foreign Application Priority Data

Sep. 30, 2020 (JP) ..... 2020-166336

(51) Int. Cl.
*D05C 9/06* (2006.01)
*D05B 19/12* (2006.01)

(52) U.S. Cl.
CPC ..... *D05C 9/06* (2013.01); *D05B 19/12* (2013.01)

(58) Field of Classification Search
CPC ... D05C 9/00; D05C 9/02; D05C 9/04; D05C 9/06; D05B 19/12; D05B 39/00
See application file for complete search history.

(56) References Cited

U.S. PATENT DOCUMENTS 1,434,898 A * 11/1922 Koller ..... D05C 9/06 112/90
2,007,819 A * 7/1935 Frederick ..... D05B 3/243 33/23.11

(Continued)

FOREIGN PATENT DOCUMENTS

JP 11061627 A * 3/1999
JP 2010-82017 A 4/2010

(Continued)

OTHER PUBLICATIONS

U.S. Appl. No. 17/199,175, filed Mar. 11, 2021 in the name of Iida et al.

(Continued)

*Primary Examiner* — Ismael Izaguirre
(74) *Attorney, Agent, or Firm* — Oliff PLC

(57) ABSTRACT

An embroidery frame includes a base frame, an opposing frame disposed in a first direction with respect to the base frame, a mounting portion, and a support member. The support member includes a support portion, a first section, a second section, and a third section. The first section includes a first inclined section extending, with respect to the opening, to the first direction and the second direction, and is coupled to the base frame or the mounting portion at a position further in the second direction than the support portion. The second section includes a second inclined section extending, with respect to the support portion, to the first direction and the second direction, and is coupled to the support portion. The third section couples the first section and the second section at a position further in the first direction than the support portion.

13 Claims, 14 Drawing Sheets

(56) References Cited

U.S. PATENT DOCUMENTS

| | | | | | |
|---|---|---|---|---|---|
| 3,730,116 | A * | 5/1973 | Schramayr | D05B 39/00 | 112/470.14 |
| 4,275,673 | A * | 6/1981 | Boser | D05B 21/00 | 112/105 |
| 4,854,251 | A * | 8/1989 | Hiramatsu | D05B 35/064 | 112/113 |
| 5,218,915 | A * | 6/1993 | Iwasaki | D05B 39/00 | 112/470.07 |
| 5,353,725 | A | 10/1994 | Sakakibara | | |
| 6,679,190 | B1 | 1/2004 | French et al. | | |
| 7,377,222 | B1 * | 5/2008 | Moore, III | D05B 39/00 | |
| 2007/0079741 | A1 * | 4/2007 | Watanabe | D05C 9/04 | 112/103 |
| 2008/0276849 | A1 | 11/2008 | Mack et al. | | |
| 2009/0267277 | A1 | 10/2009 | Mack et al. | | |
| 2012/0060732 | A1 * | 3/2012 | Viltrakis | D05C 9/04 | 112/103 |
| 2018/0320301 | A1 | 11/2018 | Kawaguchi et al. | | |
| 2020/0024783 | A1 | 1/2020 | Ueda et al. | | |

FOREIGN PATENT DOCUMENTS

| | | | |
|---|---|---|---|
| JP | 2017-148382 | A | 8/2017 |
| WO | 2005/121431 | A1 | 12/2005 |

OTHER PUBLICATIONS

Oct. 13, 2022 Office Action issued in U.S. Appl. No. 17/199,175.
Feb. 23, 2023 Office Action issued In U.S. Appl. No. 17/199,175.

* cited by examiner

EMBROIDERY FRAME AND SEWING MACHINE

CROSS-REFERENCE TO RELATED APPLICATION

This application claims priority to Japanese Patent Application No. 2020-166336 filed Sep. 30, 2020, the content of which is hereby incorporated herein by reference in its entirety.

BACKGROUND

The present disclosure relates to an embroidery frame and a sewing machine.

An embroidery frame is known which can be mounted on an embroidery sewing machine. The embroidery frame of known art is provided with a base frame, an opposing frame, and a support member. The support member supports the opposing frame on one end side of the support member and is supported by the base frame so as to be rotatable with respect to the base frame, on the other end side of the support member. The opposing frame can be rotated with respect to the base frame. The embroidery frame clamps a sewing object between the base frame and the opposing frame.

SUMMARY

A part of the sewing object clamped by the above-described embroidery frame is disposed between the support member and the base frame. Depending on a length and thickness of the sewing object disposed between the support member and the base frame, there is a possibility that the opposing frame cannot be closed with respect to the base frame, and that the sewing object cannot be held using the base frame and the opposing frame. Thus, the arrangement of an embroidery pattern in relation to a size of the sewing object becomes limited depending on a space between the support member and the base frame.

Embodiments of the broad principles derived herein provide an embroidery frame and a sewing machine that improve a freedom of arrangement of a sewing object with respect to the embroidery frame compared to known art, the embroidery frame being an embroidery frame in which an opposing frame is supported by a support member so as to be displaceable with respect to a base frame, and that holds the sewing object disposed between the base frame and the opposing frame.

Embodiments provide an embroidery frame that includes a base frame, an opposing frame, a mounting portion, and a support member. The base frame is a frame in which an opening is formed. The opposing frame is disposed in a first direction with respect to the base frame. The opposing frame is configured to hold a sewing object disposed between the opposing frame and the base frame. The mounting portion is removably mounted on a sewing machine, the mounting portion is coupled to the base frame in a second direction intersecting the first direction with respect to the opening. The support member is configured to support the opposing frame to be movable with respect to the base frame. The support member includes a support portion, a first section, a second section, and a third section. The support portion supports the opposing frame. The first section includes a first inclined section extending, with respect to the opening, to the first direction and the second direction. The first section is coupled to one selected from the group of the base frame and the mounting portion at a position further in the second direction than the support portion. The second section includes a second inclined section extending, with respect to the support portion, to the first direction and the second direction. The second section is coupled to the support portion, and the third section couples the first section and the second section, at a position further in the first direction than the support portion.

Embodiments further provide a sewing machine that includes a sewing portion, a movement portion, and an embroidery frame. The sewing portion includes a needle bar and configured to move the needle bar up and down to form stitches in a sewing object. The movement portion includes a holder and configured to move the holder with respect to the needle bar. The embroidery frame is configured to hold the sewing object. The embroidery frame includes a base frame in which an opening is formed, an opposing frame, a mounting portion, and a support member. The opposing frame is disposed in a first direction with respect to the base frame. The opposing frame is configured to hold the sewing object disposed between the opposing frame and the base frame. The mounting portion is mounted on the holder by being coupled to the base frame in a second direction intersecting the first direction with respect to the opening. The support member mounted on the holder displaceably supports the opposing frame with respect to the base frame. The support member includes a support portion, a first section, a second section, and a third section. The support portion supports the opposing frame. The first section includes a first inclined section extending, with respect to the opening, to the first direction and the second direction. The first section is coupled to one selected from the group of the base frame and the mounting portion at a position further in the second direction than the support portion. An end portion in the second direction of the first inclined section is at a position further in the second direction than the holder. The second section includes a second inclined section extending, with respect to the support portion, to the first direction and the second direction. The second section is coupled to the support portion, and the third section couples the first section and the second section, at a position further in the first direction than the support portion.

BRIEF DESCRIPTION OF THE DRAWINGS

Embodiments will be described below in detail with reference to the accompanying drawings in which.

DETAILED DESCRIPTION

Figure 1:
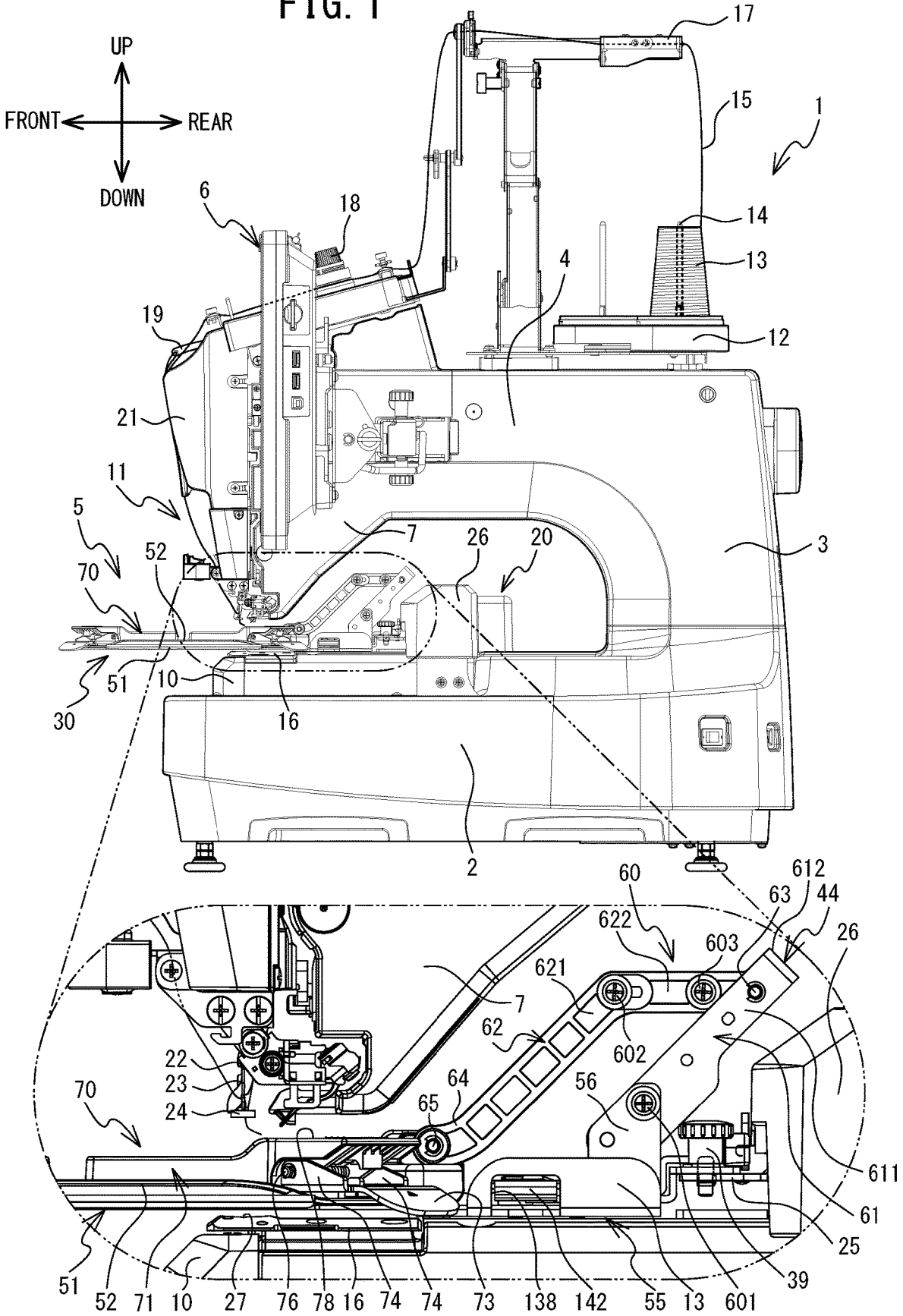
FIG. 1 is a right-side view of a sewing machine on which an embroidery frame is mounted.
Figure 2:
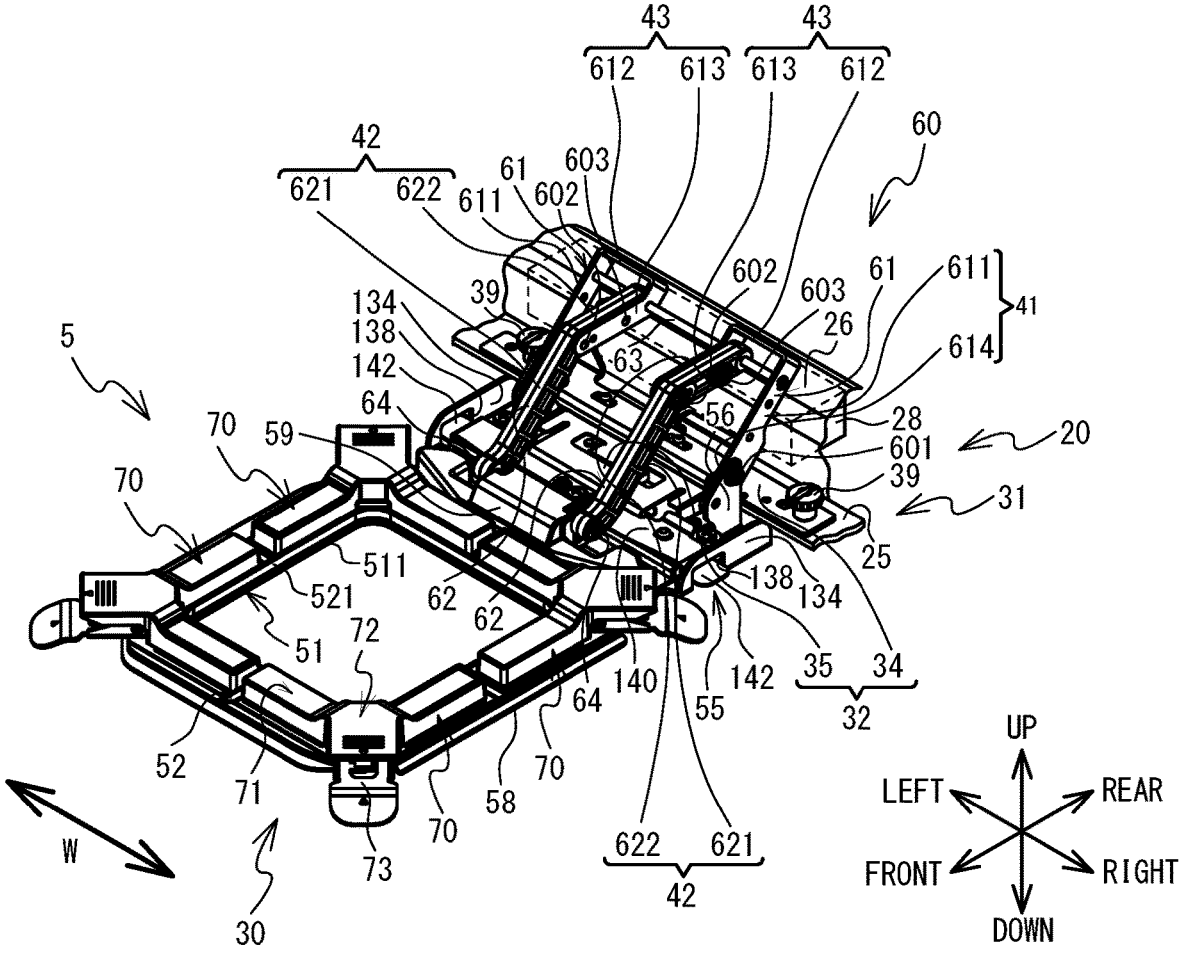
FIG. 2 is a perspective view of an embroidery frame unit mounted on a holder.

Hereinafter, a first and a second embodiment of the present disclosure will be explained with reference to the drawings. With reference to FIG. 1 and FIG. 2, a physical configuration of a multi-needle sewing machine (hereinafter referred to simply as sewing machine) 1, and an embroidery frame 5 will be explained. In the following explanation, the upper side, the lower side, the left side, and the right side in FIG. 1 are, respectively, the upper side, the lower side, the front side, and the rear side of the sewing machine 1 and the embroidery frame 5. An actual scale of mechanical elements in the drawings in the present embodiment is contracted as appropriate.

As shown in FIG. 1, the sewing machine 1 is provided with a support portion 2, a pillar 3, and an arm portion 4. The support portion 2 supports the whole of the sewing machine 1. The pillar 3 is provided standing upward from the rear end portion of the support portion 2. The arm portion 4 extends toward the front from the upper end portion of the pillar 3. A needle bar case 21 is mounted on a head portion 7 provided on the leading end of the arm portion 4 such that the needle bar case 21 can move in the left-right direction. Ten needle bars 22 that extend in the up-down direction are provided inside the needle bar case 21, the needle bars 22 being arranged at uniform intervals in the left-right direction. Of the ten needle bars 22, a sewing portion 11 drives one of the needle bars 22 that is in a sewing position, using a drive shaft motor (not shown in the drawings) as a drive source, and causes the one needle bar 22 to move slidingly up and down. A sewing needle 23 can be mounted on the lower end of the needle bar 22. A presser foot 24 intermittently presses a sewing object C (refer to FIG. 8) downward, in concert with the up and down sliding movement of the needle bar 22. The sewing object C is, for example, a sheet-shaped processing cloth, a piece of leather, a resin sheet or the like.

An operation portion 6 is provided in the arm portion 4. A cylindrical cylinder bed 10 that extends to the front from the lower end portion of the pillar 3 is provided below the arm portion 4. A needle plate 16, which is rectangular in a plan view, is provided in the upper surface of the cylinder bed 10. A needle hole 27, through which the sewing needle 23 is inserted, is provided in the needle plate 16. A shuttle (not shown in the drawings) is provided inside the leading end portion of the cylinder bed 10. The shuttle houses a bobbin (not shown in the drawings) around which a lower thread (not shown in the drawings) is wound. A shuttle drive mechanism (not shown in the drawings) is provided inside the cylinder bed 10. The shuttle drive mechanism drives the shuttle to rotate. Further, a holder 25, a Y carriage 26, and an X carriage 28 (refer to FIG. 2) of a movement portion 20 are provided below the arm portion 4. As shown in FIG. 2, the holder 25 of the movement portion 20 supports the embroidery frame 5 via a frame attachment member 31. The movement portion 20 can move the embroidery frame 5 mounted on the holder 25 to a position indicated by a unique XY coordinate system (embroidery coordinate system). As shown in FIG. 1, a pair of left and right thread spool bases 12 are provided on the rear side of the upper surface of the arm portion 4. A plurality of thread spool pins 14 are provided on each of the thread spool bases 12. The thread spool pin 14 supports a thread spool 13. An upper thread 15 is supplied from the thread spool 13 installed on the thread spool base 12. The upper thread 15 is supplied to an eye (not shown in the drawings) of each of the sewing needles 23 mounted on the lower ends of the needle bars 22, via a thread path. The thread path includes a thread guide 17, a tensioner 18, and a thread take-up lever 19.

An operation to form stitches in the sewing object C held by the embroidery frame 5 will be explained with reference to FIG. 1 and FIG. 2. The embroidery frame 5 that holds the sewing object C is supported on the holder 25 of the movement portion 20, via the frame attachment member 31. As a result of the needle bar case 21 moving to the left and the right, one of the ten needle bars 22 is selected as the needle bar 22 used for the sewing. The embroidery frame 5 is moved to a predetermined position by the movement portion 20. Using the drive shaft motor as a drive source, the sewing portion 11 drives the selected needle bar 22 and the corresponding thread take-up lever 19 up and down. Further, the shuttle drive mechanism is driven by the rotation of the drive shaft motor and the shuttle is driven to rotate. In this way, the sewing needle 23, the thread take-up lever 19, and the shuttle are driven in synchronization with each other, and the stitches are formed in the sewing object C.

Figure 3:
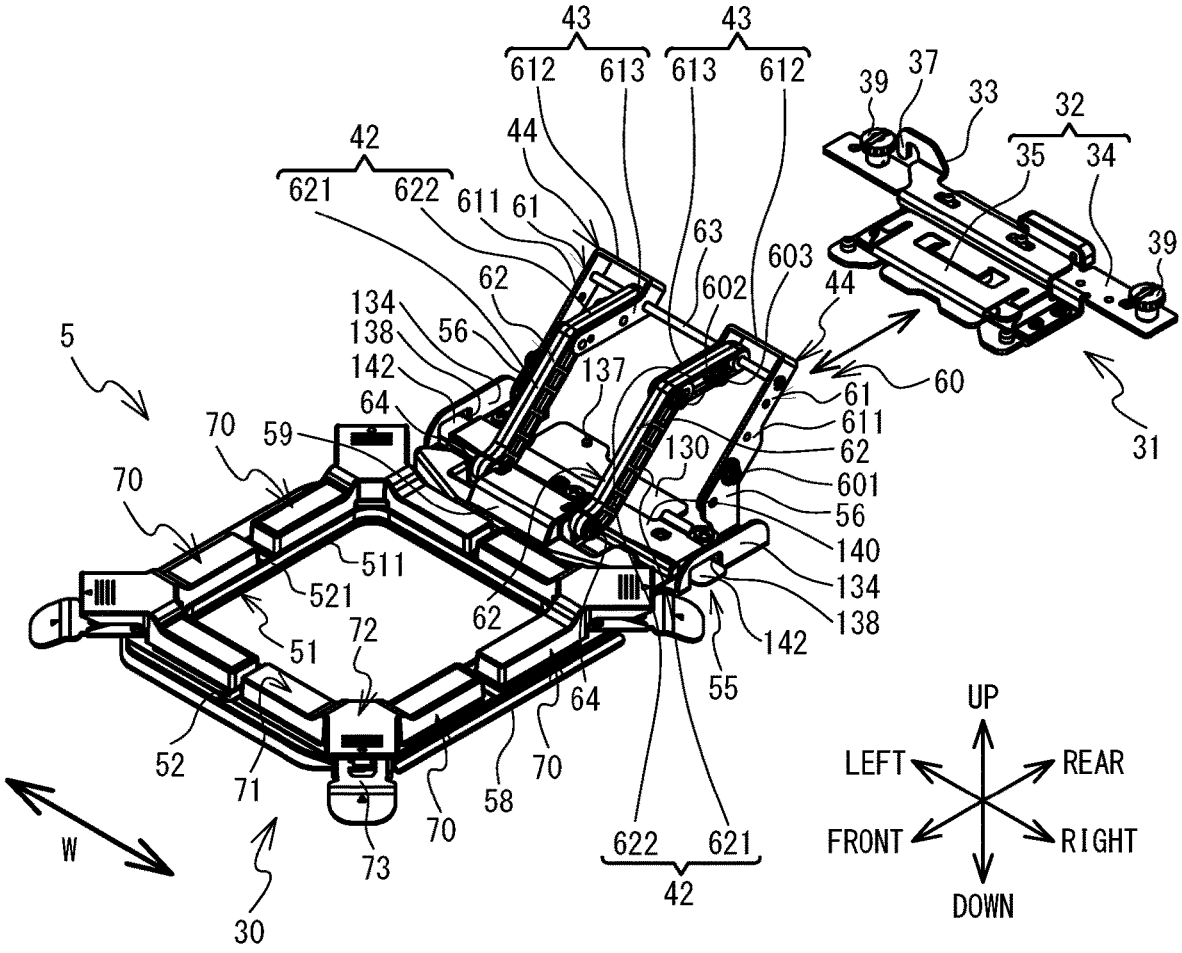
FIG. 3 is a perspective view of the embroidery frame unit in a state in which the embroidery frame is removed from a frame attachment member.

An embroidery frame unit 30 will be explained with reference to FIG. 2 to FIG. 12. As shown in FIG. 1 to FIG. 3, the embroidery frame unit 30 is a member that is removably mounted on the sewing machine 1. The embroidery frame unit 30 is provided with the embroidery frame 5 and the frame attachment member 31. The embroidery frame 5 is provided with a base frame 51, an opposing frame 52, presser members 70, a mounting portion 55, and a support member 60. The sewing object C can be held between the base frame 51 and the opposing frame 52 using magnetic force. The frame attachment member 31 is removably mounted on the holder 25 of the sewing machine 1. The embroidery frame 5 is removably mounted on the frame attachment member 31. In other words, the embroidery frame 5 can be mounted on the sewing machine 1 of the present embodiment via the frame attachment member 31. FIG. 1 and FIG. 2 show a state in which the embroidery frame 5 is mounted on the frame attachment member 31. FIG. 3 illustrates a state in which the embroidery frame 5 is removed from the frame attachment member 31. Hereinafter, a configuration of the embroidery frame 5 will be explained while taking a posture of the embroidery frame 5 when the embroidery frame 5 is mounted on the sewing machine 1 via the frame attachment member 31 as a reference.

Figure 4A:
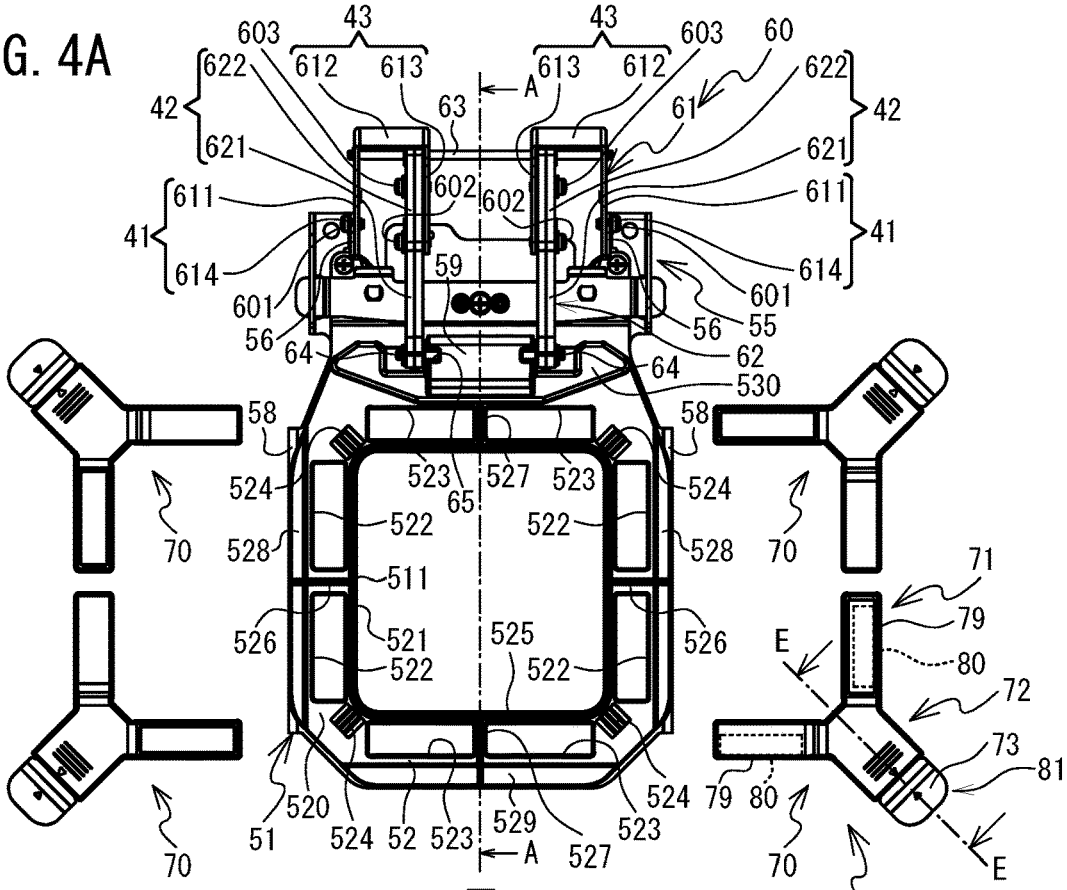
FIG. 4A is a plan view of the embroidery frame in a state in which four presser members are removed from a base frame.
Figure 4B:
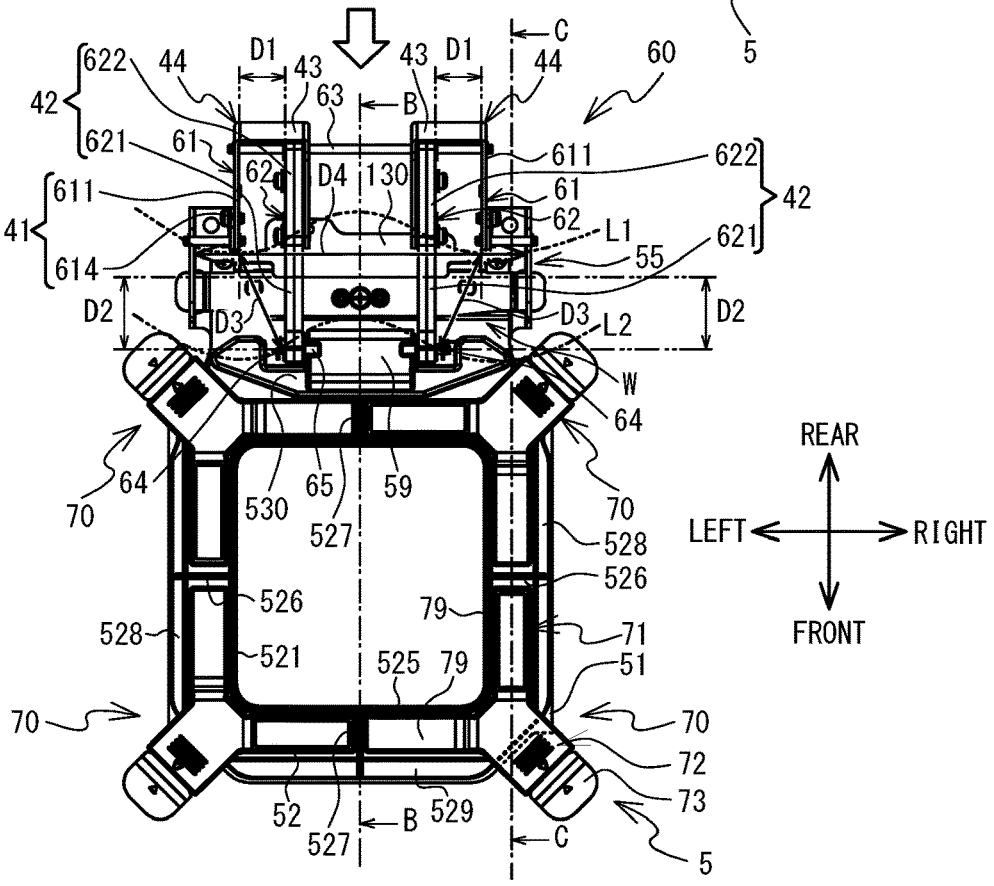
FIG. 4B is a plan view of the embroidery frame in a state in which the four presser members are disposed on the base frame.

As shown in FIG. 3, FIG. 4A and FIG. 4B, the embroidery frame 5 is substantially left-right symmetrical with respect to a center line in the left-right direction (a line A-A shown in FIG. 4A and a line B-B shown in FIG. 4B). In a plan view, the base frame 51 is a rectangular frame shape in which an opening 511 is formed that penetrates the base frame 51 in the up-down direction. At least the upper surface of the base frame 51 includes a magnetic body that is positioned facing magnets 80 of the presser members 70 to be described later. The magnetic body is a metal, such as stainless steel, for example. The base frame 51 of the present embodiment is formed entirely of the magnetic body. In a state in which the sewing object C is disposed between the base frame 51 and the opposing frame 52, the sewing object C is placed on the upper surface of the base frame 51. The base frame 51 is provided with a pair of left and right bent portions 58. Each of the pair of bent portions 58 is a portion at which both end portions, on the left and the right, of the base frame 51 are bent upward. The rear end portion of the base frame 51 is coupled to the front side portion of an attachment member 130 of the mounting portion 55 to be described later. In the present embodiment, the base frame 51 and the attachment member 130 are formed integrally by the magnetic body that is the stainless steel or the like.

The opposing frame 52 is disposed above the base frame 51, and the embroidery frame 5 can hold the sewing object C that is disposed between the base frame 51 and the opposing frame 52. As described below, the opposing frame 52 is rotatably supported with respect to the base frame 51, and below, the configuration of the opposing frame 52 will be explained taking a state in which the opposing frame 52 is closed with respect to the base frame 51 as a reference. In a plan view, the opposing frame 52 is a rectangular frame shape in which an opening 521 is formed that penetrates the opposing frame 52 in the up-down direction. In a state in which the base frame 51 and the opposing frame 52 are overlaid in the up-down direction, a plan view shape of the opening 511 and of the opening 521 are mutually aligned. As shown in FIG. 4A, two sets of pairs of holes 522, and two sets of pairs of holes 523, which penetrate the opposing frame 52 in the up-down direction, are provided in the opposing frame 52 of the present embodiment. One set of the pairs of holes 522 are aligned in the front-rear direction on a left side portion of the opposing frame 52. The other set of the pairs of holes 522 are aligned in the front-rear direction on a right side portion of the opposing frame 52. Each of the holes 522 is a rectangular shape that is long in the front-rear direction in a plan view. In a similar manner, one of the sets of the pair of holes 523 are aligned in the left-right direction in a front side portion of the opposing frame 52. The other set of the pair of holes 523 are aligned in the left-right direction in a rear side portion of the opposing frame 52. Each of the holes 523 is a rectangular shape that is long in the left-right direction in a plan view.

The opposing frame 52 is provided with an upper surface 520, four corner portions 524, a wall portion 525, a pair of left and right partitioning portions 526, a pair of front and rear partitioning portions 527, a pair of left and right guide portions 528, a front guide portion 529, a rear guide portion 530, and an insertion portion 59. Each of the corner portions 524 has a flat plate shape disposed in the four corners of the opposing frame 52, and each faces the base frame 51 in the up-down direction. The wall portion 525 protrudes upward from the upper surface 520 of the opposing frame 52, at the end portions on an inner peripheral side of the opposing frame 52. Each of the pair of left and right partitioning portions 526 is a convex portion that extends in the left-right direction and protrudes higher than the upper surface 520, at a center portion in the front-rear direction of the left side portion of the opposing frame 52 and at a center portion in the front-rear direction of the right side portion of the opposing frame 52. In the front-rear direction, each of the left and right partitioning portions 526 is provided between the corresponding pair of holes 522. Each of the pair of front and rear partitioning portions 527 is a convex portion that extends in the front-rear direction and protrudes higher than the upper surface 520, at a center portion in the left-right direction of the front side portion of the opposing frame 52 and at a center portion in the left-right direction of the rear side portion of the opposing frame 52. In the left-right direction, each of the front and rear partitioning portions 527 is provided between the corresponding pair of holes 523.

Each of the pair of left and right guide portions 528 extends in the front-rear direction at both of end portions on the left and right of the opposing frame 52. The front guide portion 529 extends in the left-right direction at the front side portion of the opposing frame 52. The pair of left and right guide portions 528 and the front guide portion 529 are inclined upward as they separate from the opening 521. The rear guide portion 530 extends in the left-right direction at the rear end portion of the opposing frame 52, and is provided standing upward from the upper surface 520 of the opposing frame 52. The pair of holes 522 in the left side portion are formed between the left guide portion 528 and the wall portion 525 in the left-right direction. The pair of holes 522 in the right side portion are formed between the right guide portion 528 and the wall portion 525 in the left-right direction. The pair of holes 523 in the front side portion are formed between the front guide portion 529 and the wall portion 525. The pair of holes 523 in the rear side portion are formed between the rear guide portion 530 and the wall portion 525.

Figure 5:
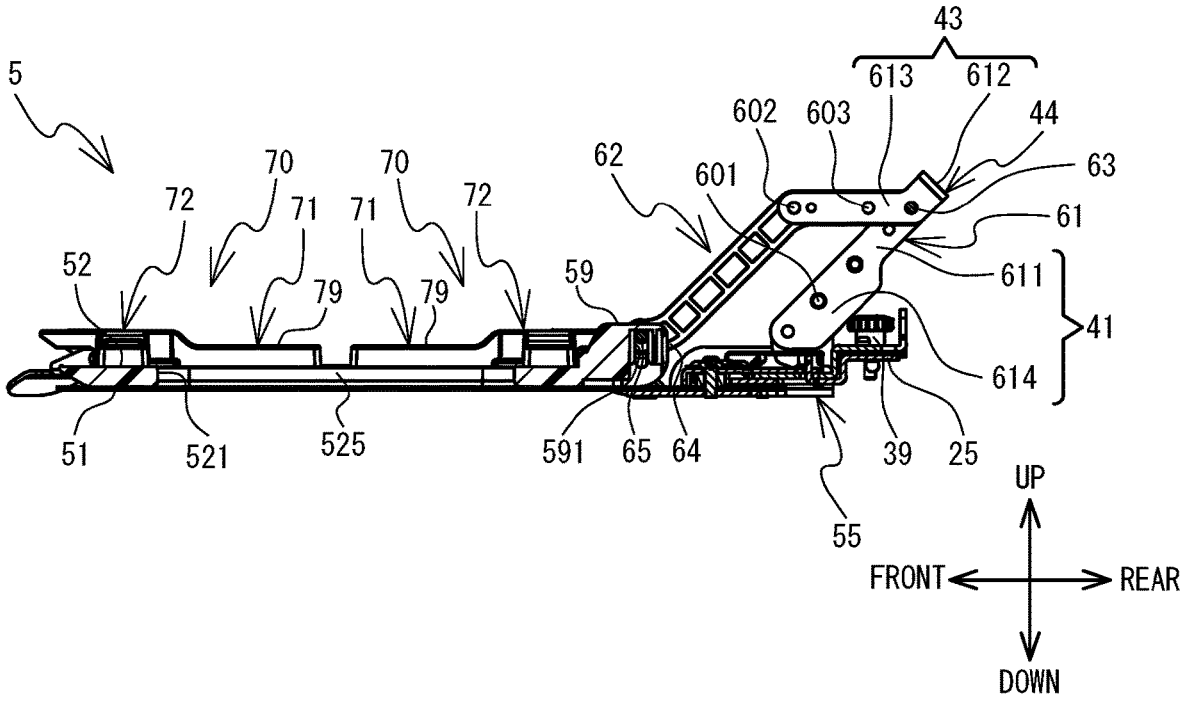
FIG. 5 is an enlarged view corresponding to a cross section in a direction of arrows along a line B-B shown in FIG. 4B.

As shown in FIG. 5, the insertion portion 59 is provided in the rear guide portion 530, and includes a long hole 591 that is long in the up-down direction and penetrates in the left-right direction. The insertion portion 59 positions the opposing frame 52 with respect to the base frame 51 in the left-right direction and the front-rear direction.

Figure 9:
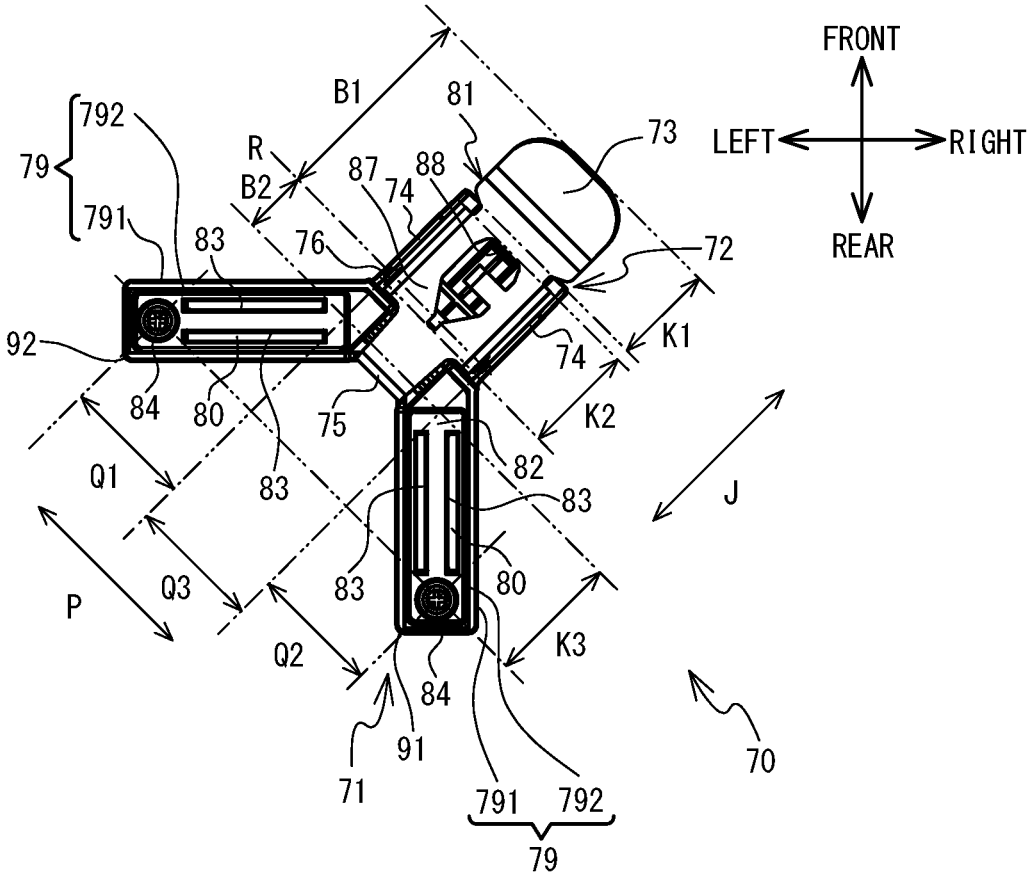
FIG. 9 is an enlarged view, from below, of the presser members.
Figure 10:
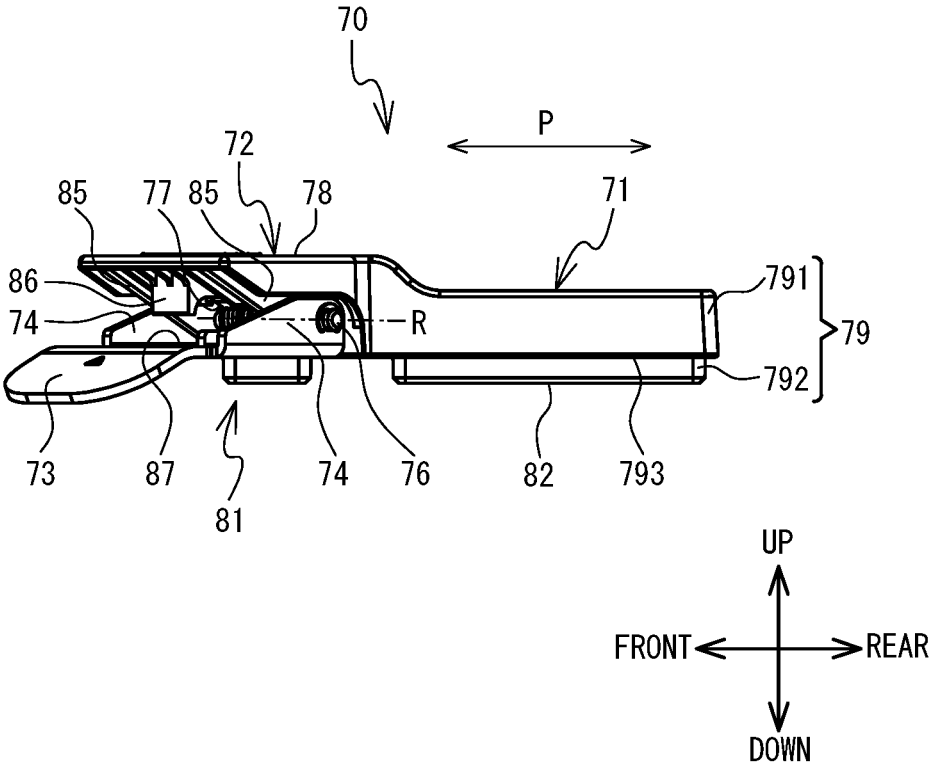
FIG. 10 is a right-side enlarged view of the presser member.

As shown in FIG. 4A and FIG. 4B, the four presser members 70 use magnetic force to press the sewing object C disposed between the base frame 51 and presser members 70 to the base frame 51 side. Since a shape of each of the four presser members 70 is mutually the same, a configuration will be explained of the presser member 70 using, as a reference, a case in which the presser member 70 disposed in a position including the corner portion 524 on the front right of the base frame 51 is disposed with respect to the base frame 51. An explanation of the other three presser members 70 will be omitted. The presser member 70 is provided with a main body portion 71 and a lever 81. The main body portion 71 has a Y shape in a plan view, and is provided with a pair of housing portions 79, a pair of the magnets 80, and a support portion 72. The pair of housing portions 79 are provided so as to be symmetrical with respect to a line E-E shown in FIG. 4A, and each has a box shape. The housing portion 79 to the left of the line E-E is a cuboid shape that is long in the left-right direction, and the housing portion 79 to the right of the line E-E is a cuboid shape that is long in the front-rear direction. As shown in FIG. 10, each of the housing portions 79 is provided with an upper portion 791 and an insertion portion 792. The insertion portion 792 is a portion that protrudes downward from a bottom surface 793 of the upper portion 791. As shown in FIG. 9, in a bottom view, a contour of the insertion portion 792 is disposed on the inside of a contour of the upper portion 791. A bottom surface of the insertion portion 792 is an opposing surface 82 that faces the base frame 51. On the opposing surface 82 of each of the housing portions 79, a pair of slits 83 are formed that extend in the lengthwise direction of the housing portion 79. The pair of slits 83 are aligned so as to be separated from each other in a short direction of the housing portion 79.

As shown in FIG. 4A and FIG. 4B, when the presser member 70 is disposed on the base frame 51, the insertion portions 792 of the pair of housing portions 79 are respectively inserted into the holes 522 and 523 adjacent to the corresponding corner portion 524 of the opposing frame 52. The bottom surface 793 of the upper portion 791 comes into contact with the upper surface 520 of the opposing frame 52. The housing portion 79 to the left of the line E-E is disposed between the front guide portion 529 and the wall portion 525 in the front-rear direction and, in the left-right direction, is disposed between the partitioning portion 527 of the front side portion of the opposing frame 52 and the corner portion 524 of the front right portion of the opposing frame 52. The housing portion 79 to the right of the line E-E is disposed between the right guide portion 528 and the wall portion 525 in the left-right direction and, in the front-rear direction, is disposed between the partitioning portion 526 of the right side portion of the opposing frame 52 and the corner portion 524 of the front right portion of the opposing frame 52.

Figure 6:
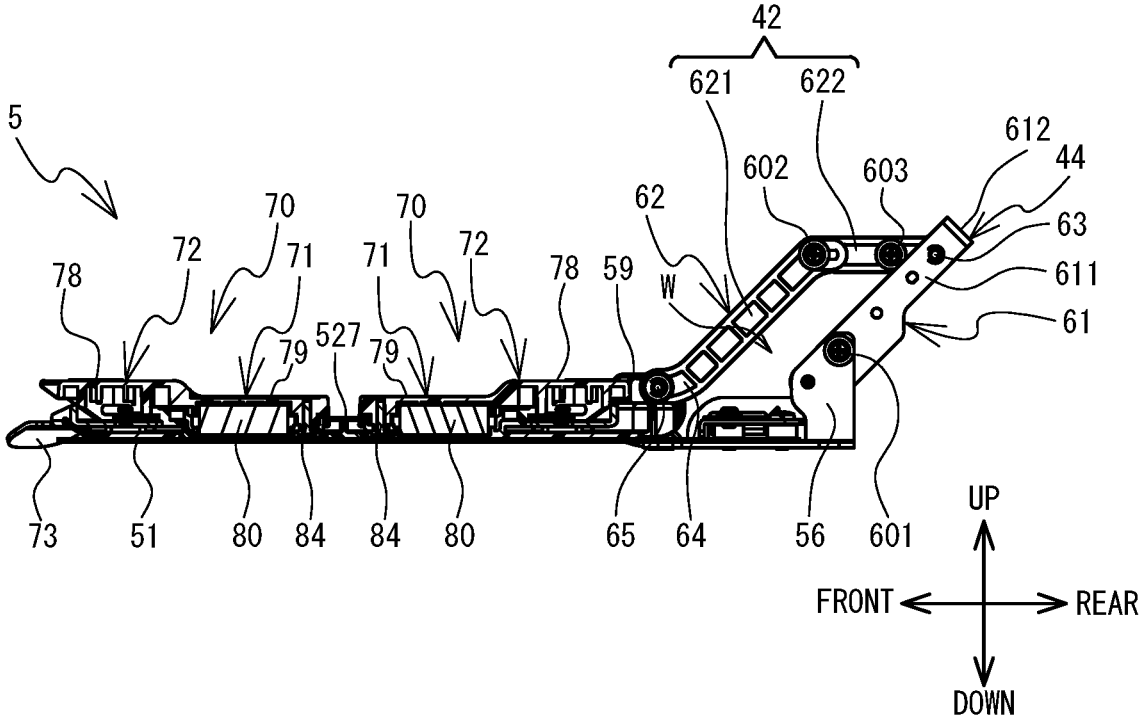
FIG. 6 is an enlarged view of a cross section in a direction of arrows along a line C-C shown in FIG. 4B.

As shown in FIG. 6, each of the pair of magnets 80 is a cuboid magnet that is housed so as to extend through the upper portion 791 and the insertion portion 792 of the corresponding housing portion 79. The presser member 70 may be provided with a yoke that guides the magnetic flux generated by the magnet 80. The magnet 80 is fixed to the housing portion 79 by a screw 84 that extends in the up-down direction and is inserted through the opposing surface 82 of the housing portion 79.

As shown in FIG. 4A, the support portion 72 is centered on the line E-E and extends along the line E-E. The support portion 72 couples the right end of the housing portion 79 to the left of the line E-E with the front end of the housing portion 79 to the right of the line E-E. As shown in FIG. 9 and FIG. 10, the support portion 72 is provided with a contact portion 78, a pair of support plate portions 85, a rotating shaft 76, an urging member 77, and a convex portion 86. The contact portion 78 is provided on a side of the main body portion 71 opposite to the opposing surface 82 that faces the magnet 80, that is, on the upper side of the main body portion 71. In the up-down direction, the upper surface of the contact portion 78 is higher than the upper surfaces of the pair of housing portions 79. In an extending direction P of the rotating shaft 76 (a rotational center R), each of the pair of support plate portions 85 extends downward from between the respective end portions of the contact portion 78 and the center of the contact portion 78 in the extending direction P of the rotating shaft 76. The further to the front right portion side, the smaller a downward protrusion amount of each of the pair of support plate portions 85. In each of the pair of support plate portions 85, a hole is formed that penetrates the support plate portion 85 in the thickness direction and through which the rotating shaft 76 is inserted. The rotating shaft 76 extends in a direction perpendicular to the line E-E and parallel to an extending surface of the base frame 51 (the extending direction P). The rotating shaft 76 is cylindrically shaped and an axial center thereof is the rotational center R of the lever 81. The rotating shaft 76 is inserted into the urging member 77. The urging member 77 is, for example, a torsion spring. Of the bottom surface of the contact portion 78, the convex portion 86 protrudes downward from a center portion of the extending direction P of the rotating shaft 76. The convex portion 86 prevents an operating body, such as a finger of a user and the like, from entering between the contact portion 78 and the lever 81.

The lever 81 is a plate-shaped member that extends along the line E-E shown in FIG. 4A. As shown in FIG. 9 to FIG. 12, the lever 81 is provided with a pair of support portions 74, a point of application portion 75, and an operation portion 73. A hole 88 that penetrates in the thickness direction is formed in the lever 81. The pair of support portions 74 are rotatably supported around the rotational center R that is the axial center of the rotating shaft 76, below the contact portion 78 of the main body portion 71. The pair of support portions 74 are portions obtained by upwardly bending both of end portions, in the extending direction P of the rotating shaft 76, of the lever 81 that is provided between the point of application portion 75 and the operation portion 73 in an extending direction J of the lever 81. The extending direction J of the lever 81 is orthogonal to the extending direction P of the rotating shaft 76. An upwardly protruding amount of each of the pair of support portions 74 from a portion 87 between the point of application portion 75 and the operation portion 73 becomes smaller the further toward the front right side. A hole that penetrates in the extending direction P of the rotating shaft 76 and through which the rotating shaft 76 is inserted is formed in each of the pair of support portions 74. The rotational center R passes through the holes provided in the pair of support portions 74. In the extending direction J of the lever 81, a distance from the rotational center R to the end portion of the support portion 74 on the operation portion 73 side is longer than a distance from the rotational center R to the end portion of the support portion 74 on the point of application portion 75 side. In the extending direction P of the rotating shaft 76, in a state in which the pair of the support plate portions 85 of the support portion 72 are disposed between the pair of support portions 74, the rotating shaft 76 is inserted through each of the holes of the pair of support portions 74 and the pair of support plate portions 85. In this way, the lever 81 is rotatably supported on the main body portion 71.

The point of application portion 75 is provided on one end side (the rear left side) of the lever 81 with respect to the rotational center R (the rotating shaft 76). When the presser member 70 is disposed on the base frame 51, the point of application portion 75 can pivot between an upper side stand-by position in which the point of application portion 75 is more separated from the base frame 51 than the opposing surface 82, and a lower side application position in which the point of application portion 75 is closer to the base frame 51 than in the stand-by position. The point of application portion 75 is a corner portion of a portion of the lever 81 obtained by bending one end of the lever 81 upward. When the presser member 70 is disposed on the base frame 51, the point of application portion 75 faces the corresponding corner portion 524, among the four corner portions 524 of the opposing frame 52. The urging member 77 urges the lever 81 in a direction in which the point of application portion 75 pivots from the application position to the stand-by position. Thus, in a state in which an external pressure is not applied to the lever 81, the point of application portion 75 is positioned in the stand-by position.

Figure 11A:
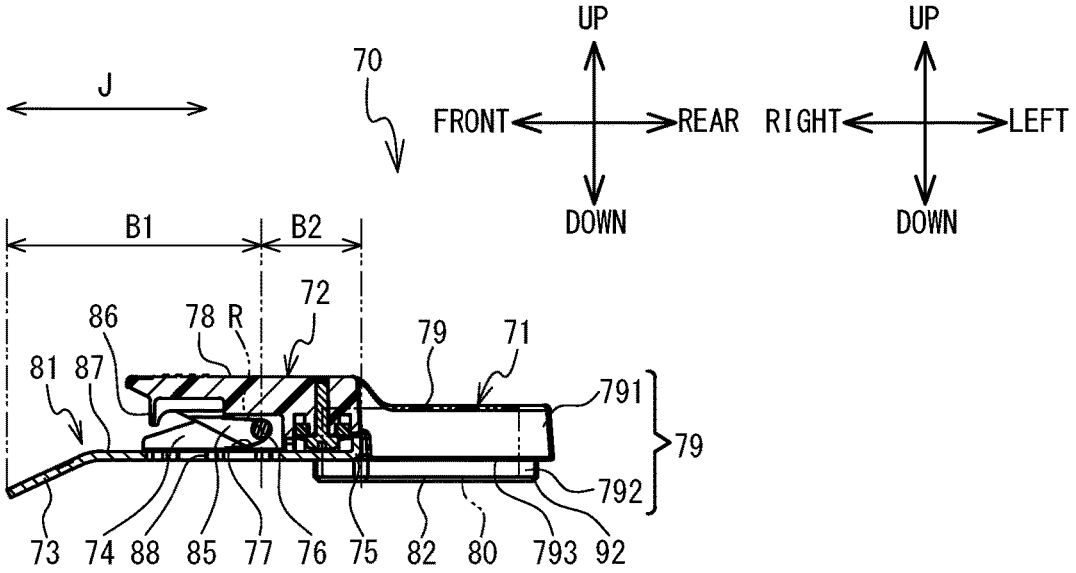
FIG. 11A is a cross-sectional view of the presser member in the direction of arrows along a line E-E shown in FIG. 4A, in a state in which a point of application portion is in a stand-by position.
Figure 11B:
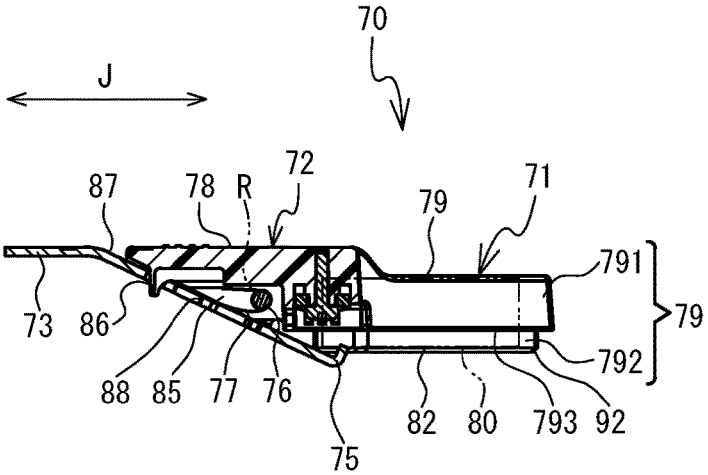
FIG. 11B is a cross-sectional view of the presser member in the direction of the arrows along the line E-E shown in FIG. 4A, in a state in which the point of application portion is in an application position.

As shown in FIG. 11A and FIG. 11B, in the extending direction J of the lever 81, the operation portion 73 is provided on another end side (the front right side) of the lever 81 with respect to the rotational center R (the rotating shaft 76), the other end side being the opposite side from the one end side. In the extending direction J of the lever 81, the operation portion 73 protrudes further to the other end side with respect to the rotational center R (the rotating shaft 76) of the lever 81 than the contact portion 78. When the operation portion 73 is moved upward by the user, the lever 81 rotates around the rotational center R of the rotating shaft 76, and the point of application portion 75 can move from the stand-by position to the application position. The operation portion 73 is bent downward with respect to the portion 87 between the rotational center R (the rotating shaft 76) and the operation portion 73. As shown in FIG. 11A, in the up-down direction, when the point of application portion 75 is in the stand-by position, the lower end portion of the operation portion 73 is positioned lower than the opposing surface 82. In the state in which the presser member 70 is disposed on the base frame 51, when the point of application portion 75 is in the stand-by position, in a plan view, as shown in FIG. 4B, the operation portion 73 is positioned on the opposite side from the opening 511 side with respect to the base frame 51 and the opposing frame 52. As shown in FIG. 9, the hole 88 is formed in substantially a center portion in the extending direction J of the lever 81. The hole 88 faces the convex portion 86 (refer to FIG. 10) of the bottom surface of the contact portion 78.

In the extending direction P of the rotating shaft 76, an extending range of the magnet 80 on the left side with respect to the support portion 72 is a range Q1, an extending range of the magnet 80 on the rear side with respect to the support portion 72 is a range Q2, and an extending range of the lever 81 is a range Q3. In the extending direction P of the rotating shaft 76, the ranges Q1 to Q3 are mutually different, and the range Q3 is between the range Q1 and the range Q2. In other words, in the extending direction P of the rotating shaft 76, the lever 81 is disposed between the pair of magnets 80.

In the extending direction J of the lever 81 that extends from the one end side to the other end side with respect to the rotational center R (the rotating shaft 76), an extending range of the operation portion 73 is a range K1, an extending range of the support portions 74 is a range K2, and an extending range of the magnets 80 is a range K3. The extending direction J of the lever 81 is a lengthwise direction of the lever 81. The point of application portion 75 is inside the range K3. Thus, in the extending direction J of the lever 81, of the point of application portion 75, the operation portion 73, and the support portions 74, at least the operation portion 73 and the support portions 74 are in positions different from the magnet 80.

As shown in FIG. 9 and FIG. 11A, in the extending direction J of the lever 81 according to the present embodiment, a first distance B1 to the rotating shaft 76 from an end of the lever 81 on the other end side (the operation portion 73 side) with respect to the rotational center R of the lever 81 (the rotating shaft 76) is longer than a second distance B2 to the rotating shaft 76 from the end of the lever 81 on the one end side (the point of application portion 75 side) with respect to the rotational center R of the lever 81 (the rotating shaft 76). The first distance B1 of the present embodiment is equal to or greater than 1.5 times the second distance B2.

As shown in FIG. 1 to FIG. 3, the mounting portion 55 can be coupled to the base frame 51, at the rear of the base frame 51 with respect to the opening 511, and can be removably mounted on the sewing machine 1. In a predetermined mounting position to be described later, the mounting portion 55 can be removably mounted using the frame attachment member 31 provided on the sewing machine 1. As shown in FIG. 3, the mounting portion 55 includes the attachment member 130, a positioning member 140, and a pair of left and right coupling portions 56. The attachment member 130 is a portion supported by the frame attachment member 31. The attachment member 130 is provided on the rear portion of the embroidery frame 5. The attachment member 130 is provided with a pair of left and right insertion portions 134, and a convex portion 137. The pair of left and right insertion portions 134 are formed by bending end portions in the left-right direction of the attachment member 130 upward, and include holes 138 that penetrate in the left-right direction. The convex portion 137 protrudes downward in the vicinity of the center, in the left-right direction, of the rear portion of the attachment member 130. The position of the convex portion 137 with respect to the attachment member 130 in the left-right direction is set to a position that is unique to the embroidery frame 5. The positioning member 140 is a member that defines the mounting position of the attachment member 130 with respect to the frame attachment member 31. The positioning member 140 extends in the left-right direction and is an elastic plate spring member. The positioning member 140 includes a pair of left and right gripping portions 142. The pair of left and right gripping portions 142 are provided on the left end and the right end of the positioning member 140, respectively. Each of the pair of left and right gripping portions 142 is a member that, when operating by the user, can move the position of the positioning member 140 in the up-down direction. As shown in FIG. 2 and FIG. 3, the pair of left and right gripping portions 142 are respectively inserted through the holes 138 in the attachment member 130. Each of the pair of left and right coupling portions 56 extends upward from the attachment member 130, between the pair of left and right insertion portions 134 in the left-right direction, and to the rear of the positioning member 140 in the front-rear direction.

As shown in FIG. 2, FIG. 3, FIG. 4A and FIG. 4B, the support member 60 supports the opposing frame 52 such that the opposing frame 52 can be displaced with respect to the base frame 51. The support member 60 is provided with a pair of left and right first members 61, a pair of left and right second members 62, and a shaft 63. Hereinafter, of the pair of left and right first members 61 and the pair of left and right second members 62, the configuration of the first member 61 and the second member 62 on the right side will be explained, and an explanation of the configuration of the first member 61 and the second member 62 on the left side will be omitted.

As shown in FIG. 4A, the first member 61 is plate-shaped and is bent into a reverse U shape in a plan view. As shown in FIG. 2, FIG. 3, FIG. 4A and FIG. 4B, the first member 61 is provided with a first section 41, and a third section 43. The first section 41 includes a first inclined section 611 and a coupling section 614. The first inclined section 611 extends upward and rearward (that is, extends diagonally upward and to the rear) with respect to the opening 511 of the base frame 51. The coupling section 614 is coupled to the mounting portion 55 at a position further to the rear than a support portion 64 to be described later. The coupling section 614 is a front right side end portion of the first member 61, and is fixed to the right coupling portion 56 of the mounting portion 55 by a screw 601. The third section 43 is provided with a section 612 that is parallel to an extending surface (a horizontal surface) of the base frame 51 and that extends in the left-right direction, and with a section 613 that is parallel to the extending surface of the base frame 51 and extends in the front-rear direction. The section 612 is coupled to the first section 41. The section 613 is coupled to a second section 42 to be described later. In other words, the third section 43 is coupled to the first section 41 and the second section 42 at a position higher than the support portion 64. A coupling section 44 that couples the first section 41 and the third section 43 according to the present embodiment is the rear end of the first inclined section 611, that is, the rear right end of the first member 61. As shown in FIG. 1 and FIG. 5, the coupling section 44 is further to the rear than the mounting portion 55. In a state in which the embroidery frame 5 is mounted on the sewing machine 1, the rear end portion of the coupling section 44 is positioned further to the rear than the holder 25.

As shown in FIG. 6, the second member 62 is a plate-shaped member bent into an obtuse angle in a right side view. As shown in FIG. 2, FIG. 3, FIG. 4A and FIG. 4B, the second member 62 is provided with the second section 42 and the support portion 64. The second section 42 includes a second inclined section 621 and a coupling section 622, and the front end portion of the second section 42 is coupled to the support portion 64. The second inclined section 621 extends upward and rearward (that is, extends diagonally upward and to the rear) with respect to the support portion 64. As shown in FIG. 1, in a right side view, the first inclined section 611 and the second inclined section 621 are inclined in a direction intersecting the base frame 51 while being substantially parallel to a shape of the rear end portion of the head portion 7 of the sewing machine 1. As shown in FIG. 2 and FIG. 4, the coupling section 622 extends rearward from the rear end of the second section 42 and substantially in parallel to the extending surface of the base frame 51. In the left-right direction, the coupling section 622 is disposed on the first inclined section 611 side (the right side) with respect to the section 613 of the first member 61, and the coupling section 622 is fixed to the right surface of the section 613 by screws 602 and 603. In this way, the second member 62 is fixed to the first member 61. The pair of second sections 42 are disposed between the pair of first sections 41 in the left-right direction.

Figure 7A:
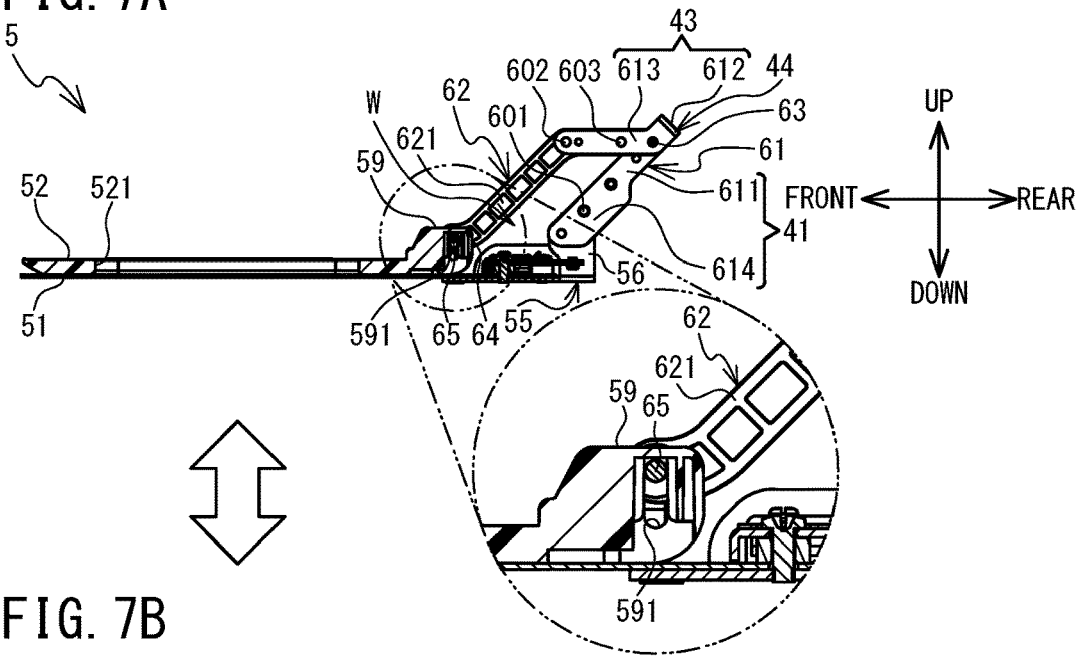
FIG. 7A is a view corresponding to a cross section in the direction of arrows along a line A-A shown in FIG. 4A when an opposing frame is in a lowered position and a closed position with respect to the base frame.
Figure 7B:
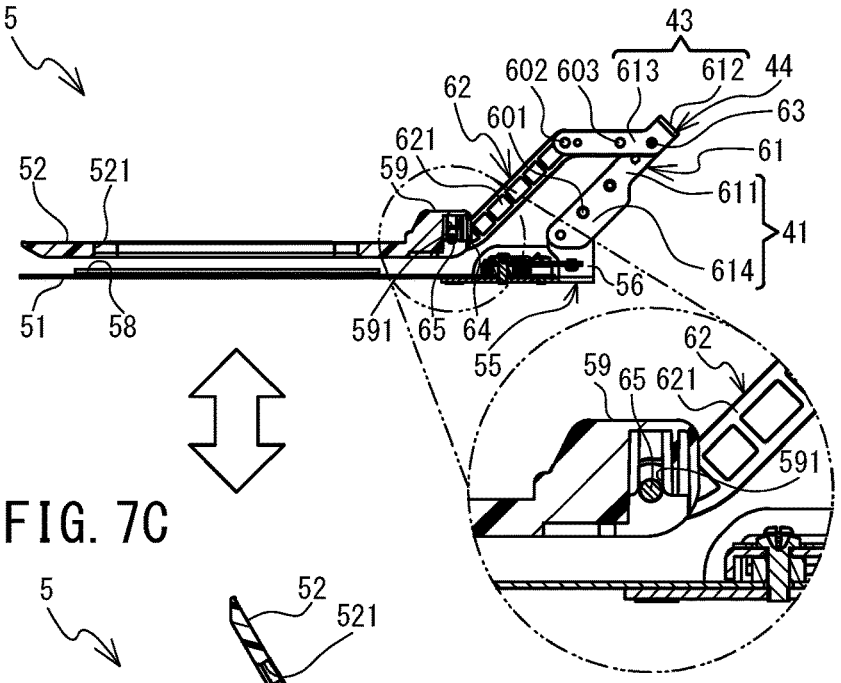
FIG. 7B is a view corresponding to the cross section in the direction of the arrows along the line A-A shown in FIG. 4A when the opposing frame is in a raised position and the closed position with respect to the base frame.
Figure 7C:
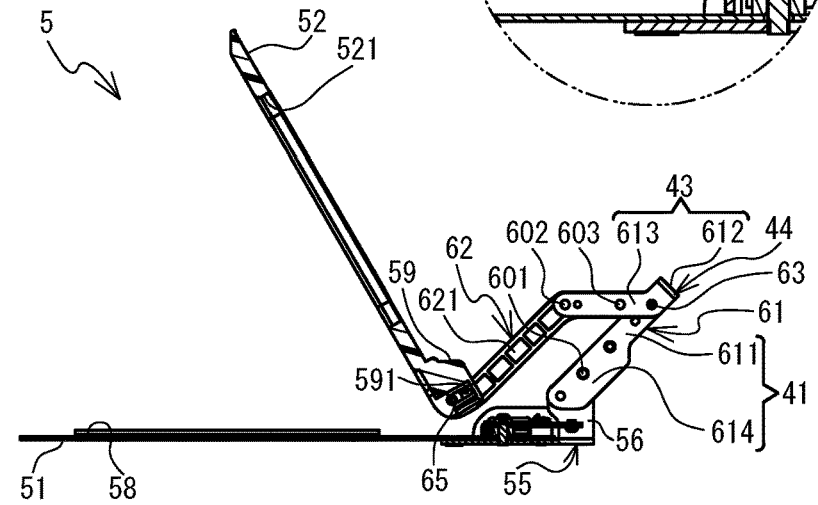
FIG. 7C is a view corresponding to the cross section in the direction of the arrows along the line A-A shown in FIG. 4A when the opposing frame is in a raised position and an open position with respect to the base frame.

The support portion 64 is the front end portion of the second member 62, and supports the opposing frame 52. The support portion 64 of the second member 62 on the left side is coupled to the left end of the shaft 65 that extends in the left-right direction, and the support portion 64 on the right side is coupled to the right end of the shaft 65. As shown in FIG. 7, the shaft 65 is inserted into the long hole 591 formed in the insertion portion 59 of the opposing frame 52. The support portion 64 supports the opposing frame 52 with respect to the base frame 51, such that the opposing frame 52 can move up and down between a lowered position shown in FIG. 7A and a raised position shown in FIG. 7B. As shown in FIG. 7A, when the opposing frame 52 is disposed in the lowered position with respect to the base frame 51, the upper surface of the base frame 51 and the bottom surface of the opposing frame 52 are in contact with each other. As shown in FIG. 7B, when the opposing frame 52 is disposed in the raised position and a closed position with respect to the base frame 51, the base frame 51 and the opposing frame 52 are disposed in parallel to each other, and the upper surface of the base frame 51 and the bottom surface of the opposing frame 52 are separated from each other. Further, the support portion 64 supports the opposing frame 52 with respect to the base frame 51 such that the opposing frame 52 can rotate between the closed position shown in FIG. 7B and an open position shown in FIG. 7C.

In the left-right direction, the front end portion of the first section 41 is preferably separated from the support portion 64. In the left-right direction, the front end portion of the first inclined section 611 is preferably in a position separated from the front end portion of the second inclined section 621. In the left-right direction, the front end portion of the first section 41 is preferably in a position separated by 5 mm or more from the support portion 64. In the left-right direction, the front end portion of the first section 41 is preferably in a position separated from the support portion 64 by 1/20 or more of the length, in the left-right direction, of the mounting portion 55. As shown in FIG. 4B, in the embroidery frame 5 of the present embodiment, the first inclined section 611 and the second inclined section 621 and separated from each other in the left-right direction, and extend substantially in parallel to each other in the front-rear direction. For example, a length D4 of the mounting portion 55 in the left-right direction is 160 mm, and a distance D1 from the front end portion of the first section 41 to the support portion 64 in the left-right direction is 22.2 mm, thus satisfying the conditions of being 5 mm or more, and being 1/20 or more of the length, in the left-right direction, of the mounting portion 55. In the front-rear direction, the front end portion of the first inclined section 611 and the support portion 64 corresponding to the first inclined section 611 are separated by a distance D2. In a plan view, the front end portion of the first inclined section 611 and the support portion 64 corresponding to the first inclined section 611 are separated by a distance D3 longer than the distance D2. As shown in FIG. 6, a space W encompassed by the first inclined section 611, the second inclined section 621, the coupling section 622, and the mounting portion 55 is a parallelogram in a right side view.

The shaft 63 is inserted through holes formed in the rear end portion of the first member 61 and the rear end portion of the second member 62, that is, the rear end portion of the first inclined section 611, the rear end portion of the coupling section 622, and the rear end portion of the section 613, and positions the first member 61 and the second member 62.

As shown in FIG. 2 and FIG. 3, the frame attachment member 31 is mainly provided with an attachment portion 32 and a switching plate 33. The embroidery frame 5 can be mounted on the attachment portion 32. The attachment portion 32 is mainly provided with an attachment member 34 and a pressing member 35. The attachment member 34 is a plate member that extends in the left-right direction. The attachment member 34 fixes the frame attachment member 31 to the holder 25 of the sewing machine 1 shown in FIG. 2, and also guides the movement of the switching plate 33. The pressing member 35 has a rectangular shape that is long in the left-right direction in a plan view. When the attachment member 130 of the embroidery frame 5 is positioned in the mounting position, the pressing member 35 is disposed above the attachment member 130, and urges the attachment member 130 to the attachment member 34 side (downward). When the gripping portions 142 are operated in the state in which the attachment member 130 is positioned in the mounting position, the pressing member 35 further urges the positioning member 140 in a removal direction. The removal direction is a movement direction of the attachment member 130 when the attachment member 130 is moved from the mounting position. The removal direction of the present embodiment is a direction opposite to a mounting direction, and is a direction from the rear toward the front. The pressing member 35 is fixed to the attachment member 34 by screws respectively inserted into through holes.

The switching plate 33 is a movement member that moves in the left-right direction in concert with an operation to mount the attachment member 130 of the embroidery frame 5 on the attachment portion 32, and is a member for which a movement amount is set in accordance with the type of the embroidery frame 5. The switching plate 33 is urged to the left by an urging member (not shown in the drawings). The switching plate 33 is provided with an engagement portion 37 provided extending upward in a hook shape from the rear left end portion of the switching plate 33. The engagement portion 37 engages with a detecting element that includes a rotary potentiometer (not shown in the drawings). The detecting element (not shown in the drawings) rotates in accordance with the movement amount of the switching plate 33. Thus, the rotary potentiometer can detect the movement amount of the switching plate 33 on the basis of a rotation amount of the detecting element. The sewing machine 1 can detect the type of the embroidery frame 5 on the basis of the rotation amount of the detecting element detected by the rotary potentiometer.

An operation to mount the embroidery frame 5 on the sewing machine 1 will be explained with reference to FIG. 2 and FIG. 3. The user inserts a pair of knob screws 39 into holes (not shown in the drawings) in the attachment member 34, and holes (not shown in the drawings) in the holder 25, and, by tightening the knob screws 39, attaches the frame attachment member 31 to the holder 25. When the embroidery frame 5 is mounted on the frame attachment member 31 mounted on the sewing machine 1, the user first horizontally moves the embroidery frame 5 in the mounting direction (to the rear). The convex portion 137 is housed in a predetermined position while being guided by the attachment member 34. At this time, depending on the position of the convex portion 137 with respect to the attachment member 34, the switching plate 33 moves to the right. When the user horizontally moves the embroidery frame 5 further in the mounting direction, the movement of the attachment member 130 in the horizontal direction is restricted, and the position of the embroidery frame 5 in the horizontal direction is fixed. Since the attachment member 130 is pressed from above by the pressing member 35, the attachment member 130 is held by the pressing member 35 and the attachment member 34. The position of the attachment member 130 is fixed in the up-down direction. As a result of the above operation, the embroidery frame 5 is mounted on the frame attachment member 31 of the sewing machine 1. The sewing machine 1 can detect the type of the embroidery frame 5 by detecting the movement amount of the switching plate 33 using the rotation amount of the detecting element.

When removing the embroidery frame 5 from the frame attachment member 31 mounted on the sewing machine 1, the user lifts up the gripping portions 142. When the gripping portions 142 are lifted upward, the positioning member 140 deflects, and is subject to a force in the removal direction from the pressing member 35. The attachment member 130 becomes able to move in the horizontal direction, and the user can smoothly move the embroidery frame 5 horizontally in the removal direction using the force in the removal direction from the pressing member 35. In other words, the user can easily remove the embroidery frame 5 from the mounting position.

Figure 8:
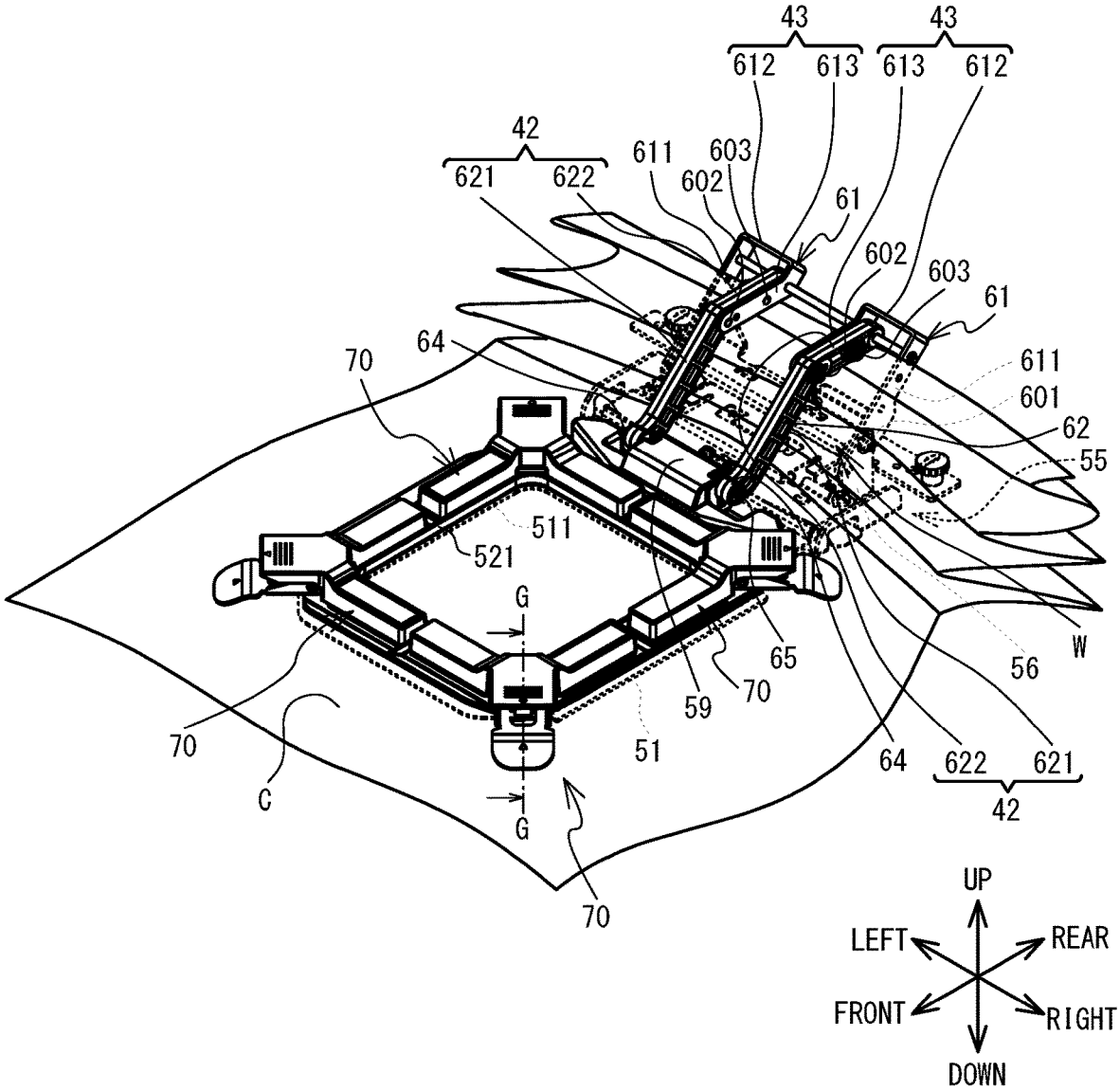
FIG. 8 is a perspective view of the embroidery frame in a state in which a sewing object is disposed between the base frame and the opposing frame

An operation to hold the sewing object C using the embroidery frame 5 will be explained with reference to FIG. 4A, FIG. 4B, FIG. 7A to FIG. 7C, and FIG. 8. When the user disposes the sewing object C on the embroidery frame 5, in a state in which the presser members 70 are retracted from the opposing frame 52, as shown in FIG. 4A, the user moves the opposing frame 52 from the lowered position shown in FIG. 7A to the raised position and the open position shown in FIG. 7C. The user disposes the sewing object C between the opposing frame 52 and the base frame 51. As shown in FIG. 8, of the end portions of the sewing object C that are not disposed between the opposing frame 52 and the base frame 51, as appropriate, the user disposes the end portion that is further to the rear than the opening 511 in the space W that, in the right side view, is encompassed by the first inclined section 611, the second inclined section 621, the coupling section 622 of the support member 60, and the mounting portion 55. In FIG. 8, the end portion of the sewing object C that is further to the rear than the opening 511 is disposed in the space W in a folded over manner in a bellows shape, but the end portion of the sewing object C may be rolled into a rolled-up shape and disposed in the space W, for example. When the end portion of the sewing object C is disposed in the space W so as to fill the space W, the portion of the sewing object C disposed in the space W comes into contact with the first inclined section 611, the second inclined section 621, the coupling section 622, and the mounting portion 55. At this time, in a lower portion inside the space W, the rear end portion of the end portion of the sewing object C comes into contact with the front end portion of the first section 41, and the front end portion of the end portion of the sewing object C comes into contact with the rear end of the support portion 64. Thus, as shown in the example in FIG. 4B, in the lower portion inside the space W, the sewing object C is disposed over a range between a curved line L1 and a curved line L2 in the front-rear direction. The curved line L1 passes through a position at which the front end portion of the first section 41 and the sewing object C come into contact with each other. The curved line L2 passes through a position at which the rear end of the support portion 64 and the sewing object C come into contact with each other. An interval in the front-rear direction between the curved line L1 and the curved line L2 is longer than the distance D2 between the front end portion of the first section 41 and the support portion 64. The user closes the opposing frame 52 with respect to the base frame 51. The user inserts the insertion portions 792 of the pair of housing portions 79 of the four presser members 70 into the corresponding holes 522 and 523, and disposes the presser members 70 with respect to the base frame 51. The four presser members 70 are guided, in accordance with the mounting position inside the opposing frame 52, by the partitioning portions 526 and 527, the pair of left and right guide portions 528, the front guide portion 529, and the rear guide portion 530, and the insertion portions 792 are inserted into the corresponding holes 522 and 523. With respect to the embroidery frame 5, in an arrangement state in which the sewing object C is disposed between the presser member 70, of which at least a part of the main body portion 71 is inserted into the holes 522 and 523 of the opposing frame 52, and the base frame 51, the presser member 70 presses the sewing object C to the base frame 51 side using the magnetic force.

Figure 12A:
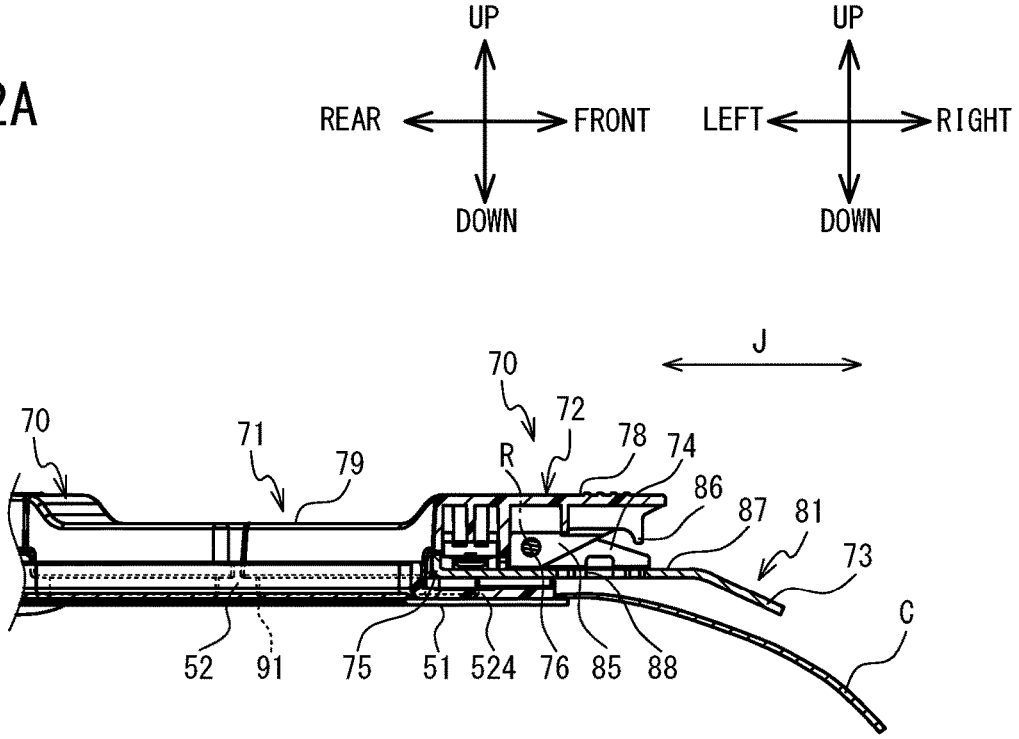
FIG. 12A is a cross-sectional view of the presser member in the direction of arrows along a line G-G shown in FIG. 8A, in a state in which the point of application portion is in the stand-by position, and FIG. 12B a cross-sectional view of the presser member in the direction of the arrows along the line G-G shown in FIG. 8A, in a state in which the point of application portion is in the application position.
Figure 12B:
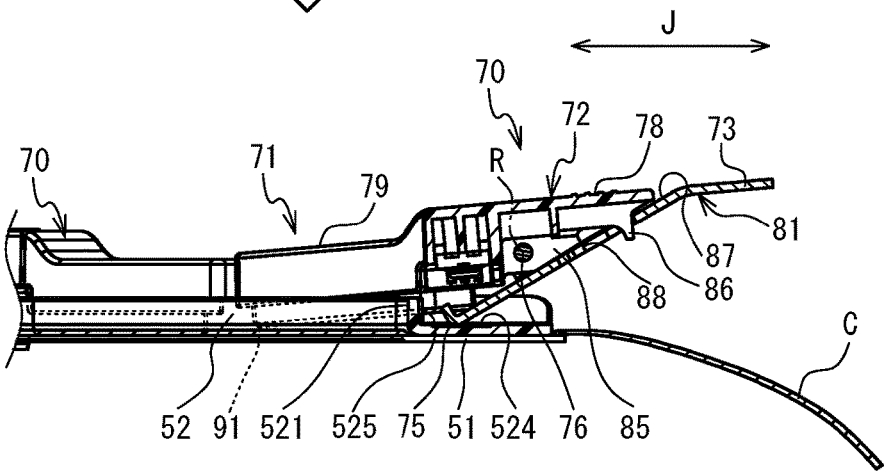

When the user wishes to remove the presser member 70 from the state in which the presser member 70 is disposed on the base frame 51, the user hooks an operating body, such as a finger or the like, on the operation portion 73 and the contact portion 78 of the presser member 70, and moves the operation portion 73 to the contact portion 78 side (upward). In accordance with the operation portion 73 being operated upward in the state in which the presser member 70 is disposed on the base frame 51, the operation portion 73 resists the urging force of the urging member 77 and moves the point of application portion 75 from the stand-by position shown in FIG. 11A and FIG. 12A to the application position shown in FIG. 11B and FIG. 12B. When the operation portion 73 is moved upward by the user, of the lever 81, the portion 87 between the rotational center R (the rotating shaft 76) and the operation portion 73 comes into contact with the contact portion 78, and thus, the movement of the operation portion 73 is restricted and the movement is stopped. The convex portion 86 on the bottom surface of the contact portion 78 is inserted into the hole 88 of the lever 81 in the course of the lever 81 rotating in accordance with the operation of the operation portion 73. In the state in which the presser member 70 is disposed on the base frame 51, the point of application portion 75 faces the opposing frame 52, and, in accordance with the operation portion 73 being operated upward, the point of application portion 75 comes into contact with the opposing frame 52, and moves the main body portion 71 upward. More specifically, of the corner portions 524, the point of application portion 75 comes into contact with the corresponding corner portion 524 in the course of moving from the stand-by position to the application position, and, using the point of application portion 75 as the point of action, the support portion 72 is lifted upward using the principle of leverage. In the lever 81 according to the present embodiment, the first distance B1 is longer than the second distance B2. Thus, the user can lift the support portion 72 upward with a relatively small force. In this way, as shown in FIG. 12B, the operation portion 73 resists the magnetic force of the magnet 80 and causes at least a part of the main body portion 71, that is, of the support portion 72 and the pair of housing portions 79, a section coupled to the support portion 72, to move upward. In a state in which the lever 81 is in contact with the contact portion 78, the upper surface of the operation portion 73 extends in parallel with the upper surface of the contact portion 78 so as to be substantially in the same plane. By lifting up the presser member 70 using, as the point of action, end portions of the pair of housing portions 79 on a side separated from the support portion 72, that is, a lower end portion 91 on the rear side of the housing portion 79 with respect to the support portion 72 and a lower end portion 92 (refer to FIG. 9 and FIG. 11B) on the left side of the housing portion 79 on the left side with respect to the support portion 72, the user can remove the presser member 70 from the base frame 51 with a small force compared to when removing the presser member 70 by gripping the main body portion 71.

The embroidery frame 5 according to the above-described embodiment is provided with the base frame 51, the opposing frame 52, the mounting portion 55, and the support member 60. The opening 511 is formed in the base frame 51. The opposing frame 52 is disposed above the base frame 51, and can hold the sewing object C placed between the base frame 51 and the opposing frame 52. The mounting portion 55 is coupled to the base frame 51 in the rearward direction intersecting the upward direction with respect to the opening 511, and is removably mounted on the sewing machine 1. The support member 60 supports the opposing frame 52 so that the opposing frame 52 can rotate with respect to the base frame 51. The support member 60 is provided with the support portion 64, the first section 41, the second section 42, and the third section 43. The support portion 64 supports the opposing frame 52. The first section 41 includes the first inclined section 611 that extends upward and to the rear with respect to the opening 511, and is coupled to the mounting portion 55 at a position further to the rear than the support portion 64. The second section 42 includes the second inclined section 621 that extends upward and to the rear with respect to the support portion 64, and is coupled to the support portion 64. The third section 43 couples the first section 41 and the second section 42, above the support portion 64. In the state in which the embroidery frame 5 is mounted on the sewing machine 1, the rear end portion of the first inclined section 611 is positioned further to the rear than the holder 25. Thus, with the embroidery frame 5, a larger part of the end portion of the sewing object C can be disposed between the first section 41 and the second section 42 in the front-rear direction, compared to known art. Thus, as a result of the sewing machine 1 using the embroidery frame 5, embroidery sewing can be performed in a center portion of the relatively large sewing object C, such as a bed cover or the like. Thus, the embroidery frame 5 can improve a degree of freedom in the arrangement of the sewing object C with respect to the embroidery frame, compared to known art. When the embroidery frame 5 is mounted on the sewing machine 1, a region that can be sewn in the rearward direction is determined in accordance with a range over which the sewing machine 1 can move the mounting portion 55 and a position of the opening 511 of the base frame 51 with respect to the mounting portion 55. Thus, in order to widen the region that can be sewn in the front-rear direction, the mounting portion 55 and the opening 511 of the base frame 51 are preferably closer. When the first section 41 extends upward only, or when the first section 41 extends to the opposite side to the rearward direction and upward, a distance between the mounting portion 55 and the opening 511 of the base frame 51 becomes longer the greater an amount of space is secured between the first section 41 and the second section 42. In contrast to this, with the embroidery frame 5 according to the present embodiment, the first section 41 extends upward and to the rear, and thus, it is possible to avoid the distance between the mounting portion 55 and the opening 511 of the base frame 51 from becoming longer while securing the space between the first section 41 and the second section 42. In the sewing machine 1, the rear end portion of the first section 41 is positioned above and to the rear of the holder 25, and thus, a space above the holder 25 can be effectively used to dispose a part of the end portion of the sewing object C.

The coupling section 44 that couples the first section 41 and the third section 43 of the embroidery frame 5 is further to the rear than the mounting portion 55. Compared to a case in which the rear end portion of the first section 41 is not further to the rear than the mounting portion 55, with the embroidery frame 5, it is possible to avoid the distance between the mounting portion 55 and the opening 511 of the base frame 51 from becoming longer while securing the space between the first section 41 and the second section 42.

In the left-right direction, the front end portion of the first section 41 is in the position separated from the support portion 64. When the front end portion of the first section 41 is in a position overlapping with the support portion 64, the distance between the front end portion of the first section 41 and the support portion 64, in the front-rear direction, is the distance D2. The distance D3 between the front end portion of the first section 41 and the support portion 64 in the embroidery frame 5 according to the above-described embodiment is the distance D3 that is longer than the distance D2. In other words, with the embroidery frame 5, compared to a case in which the front end portion of the first section 41 is in a position overlapping with the support portion 64 in the left-right direction, it is possible to cause the distance between the front end portion of the first section 41 and the support portion 64 to be longer. In this way, compared to the case in which the front end portion of the first section 41 is in the position overlapping with the support portion 64, the embroidery frame 5 can more easily secure the space between the first section 41 and the second section 42, and an even larger part of the end portion of the sewing object C can be disposed between the first section 41 and the second section 42.

In the left-right direction, the front end portion of the first inclined section 611 is in a position separated from the front end portion of the second inclined section 621. With the embroidery frame 5, compared to a case in which the front end portion of the first inclined section 611 is in a position overlapping with the front end portion of the second inclined section 621, the distance in the left-right direction between the front end portion of the first inclined section 611 and the front end portion of the second inclined section 621 can be made longer. In this way, compared to the case in which the front end portion of the first inclined section 611 is in the position overlapping with the front end portion of the second inclined section 621, the embroidery frame 5 can more easily secure the space between the first inclined section 611 and the second inclined section 621, and an even larger part of the end portion of the sewing object C can be disposed between the first section 41 and the second section 42.

In the left-right direction, the front end portion of the first section 41 is in a position separated by 5 mm or more from the support portion 64. Compared to a case in which the front end portion of the first section 41 is in a position less than 5 mm from the support portion 64 in the left-right direction, with the embroidery frame 5, it is possible to make the distance between the front end portion of the first section 41 and the support portion 64 longer. In this way, compared to the case in which the front end portion of the first section 41 is in the position overlapping with the support portion 64 in the left-right direction, the embroidery frame 5 can enable the end portion of the sewing object C to be folded in the left-right direction and more easily disposed between the first section 41 and the second section 42.

In the left-right direction, the front end portion of the first section 41 is in a position separated from the support portion 64 by 1/20 or more of the length, in the left-right direction, of the mounting portion 55. Compared to a case in which, in the left-right direction, the front end portion of the first section 41 is separated from the support portion by less than 1/20 of the length, in the left-right direction, of the mounting portion 55, the embroidery frame 5 can make the distance between the front end portion of the first section 41 and the support portion 64 longer. In this way, compared to a case in which the front end portion of the first section 41 is in a position overlapping with the support portion 64, the embroidery frame 5 can enable the end portion of the sewing object C to be folded in the left-right direction and more easily disposed between the first section 41 and the second section 42.

The support member 60 includes the coupling section 622 that extends to the rear from the rear end portion of the second inclined section 621. Compared to a case in which the support member 60 does not include the section that extends to the rear from the rear end portion of the second section 42, the embroidery frame 5 can effectively use the space above the base frame 51 and can dispose a part of the end portion of the sewing object C between the first section 41 and the second section 42.

The third section 43 includes the section 612 that extends in the left-right direction from the rear end portion of the first section 41. Compared to a case in which the third section 43 does not include the section 612 that extends in the left-right direction from the rear end portion of the first section 41, the embroidery frame 5 can effectively use the space above the base frame 51 and can dispose a part of the end portion of the sewing object C between the first section 41 and the second section 42.

The embroidery frame 5 is provided with the pair of first sections 41, and the second section 42 is disposed between the pair of first sections 41 in the left-right direction. Compared to a case in which there is only the one first section 41, the support member 60 of the embroidery frame 5 rotatably support the opposing frame 52 with respect to the base frame 51 in a stable manner.

The embroidery frame 5 is provided with the pair of second sections 42, and the pair of second sections 42 are disposed between the pair of first sections 41 in the left-right direction. Compared to a case in which there is only the one second section 42, the support member 60 of the embroidery frame 5 rotatably support the opposing frame 52 with respect to the base frame 51 in a stable manner.

An embroidery frame and a sewing machine according to the present disclosure are not limited to the above-described embodiment, and various modifications may be added insofar as they do not depart from the gist and spirit of the present disclosure. For example, the following modifications may be added. The configuration of the embroidery frame 5, the embroidery frame unit 30, the sewing machine 1 may be changed as appropriate. The number of the needle bars 22 provided in the sewing machine 1 may be any number as long as it is one or greater. A configuration may be adopted in which one or more types of the embroidery frame can be mounted on the sewing machine 1. The embroidery frame 5 may have a configuration to be directly mounted on the holder 25 of the sewing machine 1. When the embroidery frame 5 is attached to the sewing machine 1 via the frame attachment member 31, the configuration of the frame attachment member 31 may be changed as appropriate.

A size, a plan view shape, a thickness, and the like of the embroidery frame 5 may be changed as appropriate. An inner edge of each of the base frame 51 and the opposing frame 52 may be a shape other than a polygonal shape, such as a circular shape, an elliptical shape, and the like. When the inner edge of each of the base frame 51 and the opposing frame 52 is the polygonal shape, it may be a shape other than a square, such as a triangular shape, a rectangular shape, a pentagonal shape, and the like.

As long as the support member 60 supports the opposing frame 52 with respect to the base frame 51, the shape, the configuration, and the arrangement of the support member 60 of the embroidery frame 5 may be changed as appropriate. For example, the pair of first members 61 and the pair of second members 62 may be integrally formed with the support member 60. The support member 60 may support the opposing frame 52 such that the opposing frame 52 does not rotate with respect to the base frame 51. The arrangement, the length, the extending direction, and the like of the first inclined section 611 in the first section 41 may be changed as appropriate. Similarly, the arrangement, the length, the extending direction, and the like of the second inclined section 621 in the second section 42 may be changed as appropriate. For example, the second section 42 need not necessarily be provided with the coupling section 622, and may be provided with a section that extends downward or to the front from the front end of the second inclined section 621. The positions, in the left-right direction, of the front end portion of the first section 41 and the support portion 64 may be the same as each other. The positions, in the left-right direction, of the front end of the first inclined section 611 and the front end of the second inclined section 621 may be the same as each other. The first inclined section 611 and the second inclined section 621 may extend in directions intersecting each other. The third section 43 need not necessarily include at least one selected from the group of the section 612 that extends in the left-right direction, and the section 613 that extends in the front-rear direction, and, for example, the first section 41 and the second section 42 may be sections that are directly coupled to each other. The positions, in the front-rear direction, of the rear end of the first inclined section 611 and the rear end of the second inclined section 621 may be the same as each other. The coupling section 44 that couples the first section 41 and the third section 43 may be further to the front than the mounting portion 55. The support member 60 may be coupled to the base frame 51 at a position further to the rear than the support portion 64. The support member 60 may rotatably support the opposing frame 52 with respect to the base frame 51 as a result of the support portion 64 supporting the opposing frame 52 in a non-rotatable manner with respect to the base frame 51, and the first member 61 rotatably supporting the second member 62. The support member 60 may support the opposing frame 52 so as to be displaceable with respect to the base frame 51 (so as to be able to approach and be separated from the base frame 51). Displace is a concept referring to a relative position between the opposing frame 52 and the base frame 51 being changed, and includes rotation and movement. More specifically, the support member 60 may support the opposing frame 52 to be rotatable with respect to the base frame 51, may support the opposing frame 52 so as to be movable in the thickness direction with respect to the base frame 51, or, as in the case of the embroidery frame 5 of the above-described embodiment, may support the opposing frame 52 so as to be rotatable and movable in the thickness direction with respect to the base frame 51.

Figure 13:
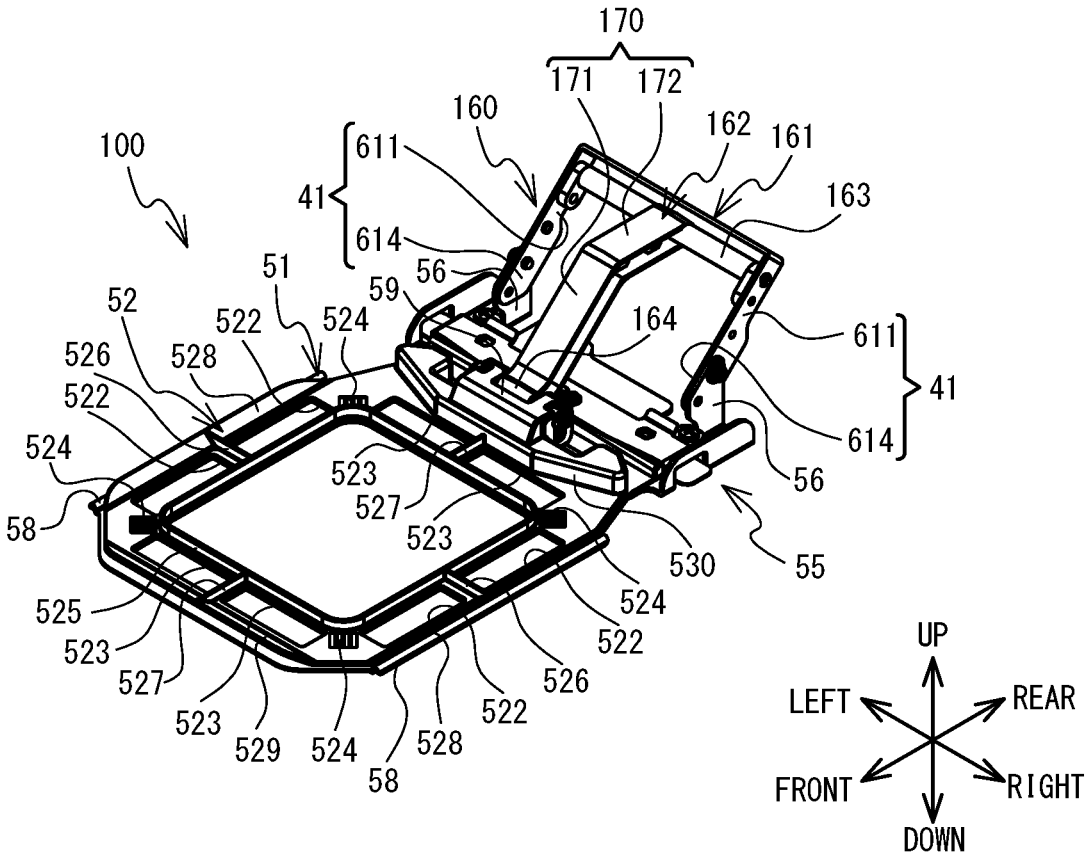
FIG. 13 is a perspective view of an embroidery frame according to a modified example.
Figure 14:
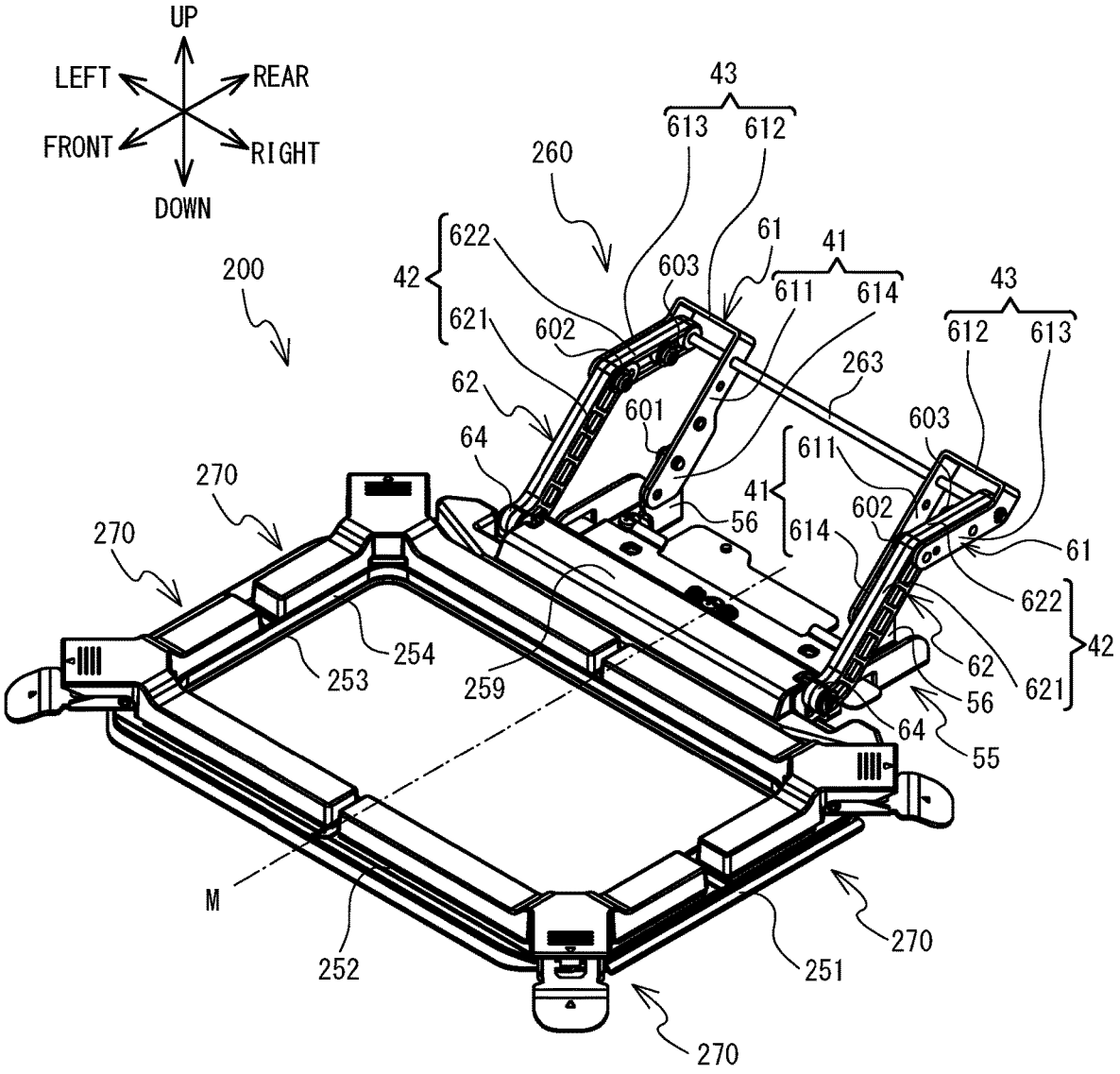
FIG. 14 is a perspective view of an embroidery frame according to a modified example.

Hereinafter, a configuration of embroidery frames 100 and 200, in which the configurations of the embroidery frame 5 and the support member 60 are mutually different, will be explained in order. In FIG. 13 and FIG. 14, the same reference signs will be assigned to the configuration elements that are the same as those of the embroidery frame 5 of the above-described embodiment. As shown in FIG. 13, in place of the support member 60 of the embroidery frame 5, the embroidery frame 100 of a modified example is provided with a support member 160, and the configuration of the base frame 51, the opposing frame 52, and the presser member 70, which is not illustrated in FIG. 13, are the same as those of the embroidery frame 5 of the above-described embodiment. The support member 160 of the embroidery frame 100 is provided with a first member 161 having a reverse U shape in a plan view, a second member 162 that is plate-shaped and bent into an obtuse angle in a right side view, and a third section 163. The first member 161 includes the pair of first sections 41, on both left and right end portions of the first member 161, in a similar manner to the embroidery frame 5. The second member 162 is provided with a support portion 164 and a second section 170. The support portion 164 supports the opposing frame 52 so as to be able to approach and be separated from the base frame 51 and so as to be rotatable with respect to the base frame 51. The first section 41 includes the first inclined section 611 that extends upward and to the rear with respect to the opening 511, and is coupled to the mounting portion 55 at a position further to the rear than the support portion 164. The second section 170 includes a second inclined section 171 that extends upward and to the rear with respect to the support portion 164, and a section 172 that extends to the rear from the rear end of the second inclined section 171. In the left-right direction, the second section 170 is positioned between the pair of first sections 41. The front end of the second section 170 is coupled to the support portion 164. The third section 163 is coupled to the pair of first sections 41 and the second section 170, at a position higher than the support portion 164.

As shown in FIG. 14, in place of the support member 60 of the embroidery frame 5, the embroidery frame 200 of a modified example is provided with a support member 260, and in this respect the configurations of the embroidery frame 200 and the embroidery frame 5 are mutually different. The embroidery frame 200 of the modified example is different from the embroidery frame 5 in that the embroidery frame 200 is provided with a base frame 251, an opposing frame 252, and presser members 270, in place of the base frame 51, the opposing frame 52, and the presser members 70. The embroidery frame 200 is a rectangular frame shape that is long in the left-right direction in a plan view. The base frame 251 includes an opening 253 and an insertion portion 259. The opposing frame 252 includes an opening 254. A shape of each of the base frame 251, the opposing frame 252, and the presser member 270 is different from that of the base frame 51, the opposing frame 52, the presser member 70, but a basic configuration is the same as that of the base frame 51, the opposing frame 52, and the presser member 70, and an explanation thereof will be omitted below, and the support member 260 will be explained. As shown in FIG. 14, the support member 260 is provided with the pair of first members 61 and the pair of second members 62, in the same way as the embroidery frame 5. The support member 260 is further provided with a shaft 263. The first member 61 is fixed to the coupling portion 56 of the mounting portion 55, in a posture in which, with respect to the first section 41, the third section 43 is disposed on a side separated from a center M, in the left-right direction, of the embroidery frame 200. In the left-right direction, the coupling section 622 of the second section 42 is disposed on the center M side with respect to the section 613, and is fixed to the section 613 by screws 602 and 603. In the left-right direction, the pair of first sections 41 are disposed between the pair of second sections 42. The size of the embroidery frame 200 in the left-right direction is larger than the embroidery frame 5, and, compared to the case in which the pair of second sections 42 are disposed between the pair of first sections 41 in the left-right direction, as in the embroidery frame 5, having the pair of second sections 42 disposed on the outside of the pair of first sections 41 (on a side separated from the center M) means that the opposing frame 52 can be supported in a more stable manner.

The embroidery frame 5 need not necessarily hold the sewing object C disposed between the base frame 51 and the opposing frame 52 using the magnetic force of the magnets 80. For example, the embroidery frame 5 may fix an outer periphery of the base frame 51 and the opposing frame 52 as appropriate, using a clip or the like, the sewing object C may be pressed to the base frame 51 side by the weight of the opposing frame 52, or the sewing object C may be pressed to the base frame 51 side by driving an actuator, such as an air cylinder or the like, provided on the opposing frame 52. In the embroidery frame 5, the magnets 80 may be provided in the opposing frame 52 such that the magnets 80 cannot be removed. In the embroidery frame 5, in place of the presser members 70, the magnets 80 may be removably provided on the opposing frame 52. When the embroidery frame 5 is provided with the presser members 70, the configuration of the presser member 70 may be changed as appropriate in accordance with the shape, the size, and the like of the embroidery frame 5. In the state in which the presser member 70 is disposed with respect to the base frame 51, the point of application portion 75 of the presser member 70 need not necessarily face the opposing frame 52, and may face the sewing object C or the base frame 51. In the state in which the presser member 70 is disposed with respect to the base frame 51, when the point of application portion 75 of the presser member 70 faces the corner portion 524 of the base frame 51, the corner portion 524 may protrude further upward than the upper surface 520 of the opposing frame 52. In this type of case, the application position need not necessarily be the position in which the lower end of the point of application portion 75 in the application position is lower than the opposing surface 82 of the housing portion 79.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame comprising:

a base frame in which an opening is formed;

an opposing frame disposed in a first direction with respect to the base frame, the opposing frame being configured to hold a sewing object disposed between the opposing frame and the base frame;

a mounting portion removably mounted on a sewing machine, the mounting portion being coupled to the base frame in a second direction intersecting the first direction with respect to the opening; and a support member configured to support the opposing frame to be movable with respect to the base frame, the support member including a support portion, a first section, a second section, and a third section, the support portion supporting the opposing frame, the first section including a first inclined section extending, with respect to the opening, to the first direction and the second direction, the first section being coupled to one selected from the group of the base frame and the mounting portion at a position further in the second direction than the support portion, the second section including a second inclined section extending, with respect to the support portion, to the first direction and the second direction, the second section being coupled to the support portion, and the third section coupling the first section and the second section, at a position further in the first direction than the support portion, wherein in a fourth direction intersecting the first direction and the second direction, an end portion of the first section in a third direction on an opposite side from the second direction is in a position separated from the support portion.

2. The embroidery frame according to claim 1, wherein a coupling section coupling the first section and the third section is in a position further in the second direction than the mounting portion.

3. The embroidery frame according to claim 1, wherein in the fourth direction, an end portion of the first inclined section in the third direction in a position separated from an end portion of the second inclined section in the third direction.

4. The embroidery frame according to claim 1, wherein in the fourth direction, the of the first section in the third direction is in a position separated from the support portion by at least 5 mm.

5. The embroidery frame according to claim 1, further comprising:

in the fourth direction, the end portion of the first section in the third direction is in a position separated from the support portion by at least 1/20 of a length of the mounting portion in the fourth direction.

6. The embroidery frame according to claim 1, wherein the third section includes a section extending in the second direction from an end portion of the second section in the second direction.

7. The embroidery frame according to claim 1, wherein the third section includes a section extending in the fourth direction, from an end portion of the first section in the second direction.

8. The embroidery frame according to claim 1, further comprising:

a pair of the first sections, wherein the second section is disposed between the pair of first sections in the fourth direction.

9. The embroidery frame according to claim 8, further comprising:

a pair of the second sections, wherein the pair of second sections are disposed between the pair of first sections in the fourth direction.

10. The embroidery frame according to claim 1, further comprising:

a pair of the second sections, wherein the first section is disposed between the pair of second sections in the fourth direction.

11. The embroidery frame according to claim 10, further comprising:

a pair of the first sections, wherein the pair of first sections are disposed between the pair of second sections in the fourth direction.

12. The embroidery frame according to claim 1, further comprising:

a magnet mounted on the opposing frame, wherein one selected from the group of the support portion and the opposing frame includes a long hole long in the first direction, another selected from the group of the support portion and the opposing frame includes a shaft inserted into the long hole, the support portion rotatably supports the opposing frame with respect to the base frame, the base frame includes a magnetic body, and the opposing frame clamps the sewing object, together with the base frame, using the magnet mounted on the opposing frame.

13. A sewing machine comprising:

a sewing portion including a needle bar and configured to move the needle bar up and down to form stitches in a sewing object;

a movement portion including a holder and configured to move the holder with respect to the needle bar; and an embroidery frame configured to hold the sewing object, the embroidery frame including a base frame in which an opening is formed, an opposing frame, a mounting portion, and a support member, the opposing frame being disposed in a first direction with respect to the base frame, the opposing frame being configured to hold the sewing object disposed between the opposing frame and the base frame, the mounting portion being mounted on the holder by being coupled to the base frame in a second direction intersecting the first direction with respect to the opening, the support member mounted on the holder displaceably supporting the opposing frame with respect to the base frame, the support member including a support portion, a first section, a second section, and a third section, the support portion supporting the opposing frame, the first section including a first inclined section extending, with respect to the opening, to the first direction and the second direction, the first section being coupled to one selected from the group of the base frame and the mounting portion at a position further in the second direction than the support portion, an end portion in the second direction of the first inclined section being at a position further in the second direction than the holder, the second section including a second inclined section extending, with respect to the support portion, to the first direction and the second direction, the second section being coupled to the support portion, and the third section coupling the first section and the second section, at a position further in the first direction than the support portion, wherein in a fourth direction intersecting the first direction and the second direction, an end portion of the first section in a third direction on an opposite side from the second direction is in a position separated from the support portion.

* * * * *